US008292294B2

(12) United States Patent
Masuda et al.

(10) Patent No.: US 8,292,294 B2
(45) Date of Patent: Oct. 23, 2012

(54) SHEET TRANSPORTATION DEVICE INCLUDING ELECTROMAGNETIC COMPONENT AND CONTROL METHOD THEREOF

(75) Inventors: Junichi Masuda, Toyokawa (JP); Masayuki Watanabe, Fuchu (JP); Takeshi Ishida, Toyohashi (JP); Takahiro Tsujimoto, Toyokawa (JP); Takahiro Yokoya, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/019,499

(22) Filed: Feb. 2, 2011

(65) Prior Publication Data

US 2011/0187043 A1 Aug. 4, 2011

(30) Foreign Application Priority Data

Feb. 4, 2010 (JP) ..... 2010-023263

(51) Int. Cl.
*B65H 7/02* (2006.01)
*B65H 43/00* (2006.01)

(52) U.S. Cl. ..... 271/258.01; 271/265.01; 271/176

(58) Field of Classification Search ..... 271/258.01, 271/258.04, 265.01, 176
See application file for complete search history.

(56) References Cited

U.S. PATENT DOCUMENTS

2007/0035202 A1 2/2007 Imai
2009/0310177 A1 12/2009 Takahashi et al.

FOREIGN PATENT DOCUMENTS

JP 62-240233 A 10/1987
JP 5-193230 A 8/1993
JP 2005-278348 A 10/2005
JP 2007-37356 A 2/2007
JP 2008-164999 A 7/2008
JP 2008-230002 A 10/2008
JP 2009-11137 A 1/2009
JP 2009-300746 A 12/2009

OTHER PUBLICATIONS

Official Action issued on Dec. 6, 2011 by the Japanese Patent Office in corresponding Japanese Patent Application No. 2010-023263 and English language translation of the Official Action.
Japanese Office Action, mailed Sep. 13, 2011, with English-language translation.

*Primary Examiner* — David H Bollinger
(74) *Attorney, Agent, or Firm* — Buchanan Ingersoll & Rooney PC

(57) ABSTRACT

A sheet transportation device includes a transportation path for transportation of a sheet, a transportation unit for applying force to a sheet on the transportation path, and an electromagnetic component for driving the transportation unit by receiving supply of electric power. At the sheet transportation device, the absence/presence of a sheet is detected at a downstream side of the region where the transportation unit applies force to a sheet in the transportation path, and counter electromotive force induced in response to electric power being supplied to the electromagnetic component is supplied as the electric power for the detector.

27 Claims, 14 Drawing Sheets

FIG.8

●ENERGY (J) GENERATED BY CLUTCH L $$J=\frac{1}{2}\times L\times I^2 \cdots (1)$$

(L : SELF-INDUCTANCE OF CLUTCH SOLENOID L1
I : VALUE OF CURRENT FLOWING TO CLUTCH SOLENOID L1 WHEN ELECTRIC POWER IS SUPPLIED FROM DIRECT CURRENT POWER SUPPLY Vcc1)

●POWER (W) CONSUMED AT PHOTOSENSOR CIRCUIT $$W=R\times i^2+V_F\times i \cdots (2)$$

(i : VALUE OF CURRENT FLOWING TO PHOTOSENSOR 592 CIRCUIT
R : RESISTANCE VALUE OF RESISTOR R1
$V_F$ : VOLTAGE APPLIED TO LIGHT-EMITTING ELEMENT 592A)

●EQUATION DERIVED FROM RELATION OF W = J × t $$\left(\frac{1}{2}\times L\times I^2\right)\times t=R\times i^2+V_F\times i \cdots (3)$$

●MODIFICATION OF EQUATION (3) FOR t $$t=\frac{R\times i^2+V_F\times i}{\frac{1}{2}\times L\times I^2} \cdots (4)$$

SHEET TRANSPORTATION DEVICE INCLUDING ELECTROMAGNETIC COMPONENT AND CONTROL METHOD THEREOF

This application is based on Japanese Patent Application No. 2010-023263 filed with the Japan Patent Office on Feb. 4, 2010, the entire content of which is hereby incorporated by reference.

BACKGROUND OF THE INVENTION

1. Field of the Invention

The present invention relates to sheet transportation devices, particularly a sheet transportation device including an electromagnetic component.

2. Description of the Related Art

A device configured to transport a sheet (original document, recording paper, and the like) such as an image formation apparatus conventionally employs an electromagnetic component such as a solenoid, motor, and actuator. As used herein, an electromagnetic component refers to a component utilizing electromagnetic force, functioning in the device through electromagnetic force. In such components utilizing electromagnetic force, terminating the application of current for inducing a magnetic field causes counter electromotive force, i.e. electromotive force to cancel change in the magnetic field caused by terminating application of current.

Japanese Laid-Open Patent Publication No. 2008-164999 discloses the approach to absorb counter electromotive force induced in a motor by means of a diode connected parallel to an interlock switch in order to avoid damage at a drive unit caused by a current through counter electromotive force in a printer, a multifunction device, or the like.

In the field of such devices, there is a constant demand for improving the reliability of the device by preventing damage to components, as well as reducing power consumption. Japanese Laid-Open Patent Publication No. 05-193230 discloses a printer device directed to realizing reliability and reduction in power consumption. There is disclosed the approach to control the ON/OFF of a power supply periodically to actuate a sensor, and latch the output signal from the sensor according to a timing signal related to the timing of the ON/OFF control.

The technique disclosed in Japanese Laid-Open Patent Publication No. 05-193230 does not take into account induction of counter electromotive force that is a conventional problem.

SUMMARY OF THE INVENTION

In view of the foregoing, an object of the present invention is to provide a sheet transportation device including an electromagnetic component, directed to ensuring reliability by avoiding a problem caused by counter electromotive force expected to be induced while reducing power consumption.

A sheet transportation device according to the present invention includes a transportation path for transportation of a sheet, a transportation unit for applying force to a sheet on the transportation path, an electromagnetic component for driving the transportation unit through supply of electric power, a detector provided at the transportation path downstream of a region where the transportation unit applies force to the sheet for detecting absence/presence of a sheet in the transportation path, and a supply unit supplying, as the electric power of the detector, counter electromotive force induced in response to the electromagnetic component receiving supply of electric power for driving the transportation unit.

A control method of a sheet transportation device according to the present invention is directed to a method of controlling a sheet transportation device including a transportation unit for applying force to a sheet on a transportation path, an electromagnetic component for driving the transportation unit through supply of electric power, and a detector for detecting absence/presence of a sheet on the transportation unit. The control method of a sheet transportation device includes the steps of: supplying electric power to the electromagnetic component for the transportation unit to apply force to the sheet; detecting absence/presence of a sheet in the transportation path downstream of the region where the transportation unit applies force to the sheet in the transportation path; and supplying to the detector, counter electromotive force induced in response to the electromagnetic component receiving supply of electric power.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 is a diagram to describe a quantitative condition for utilizing the counter electromotive force of the electromagnetic component as a source of electric power for the detector at the sheet feeder of the MFP.

DESCRIPTION OF THE PREFERRED EMBODIMENTS

Figure 1:
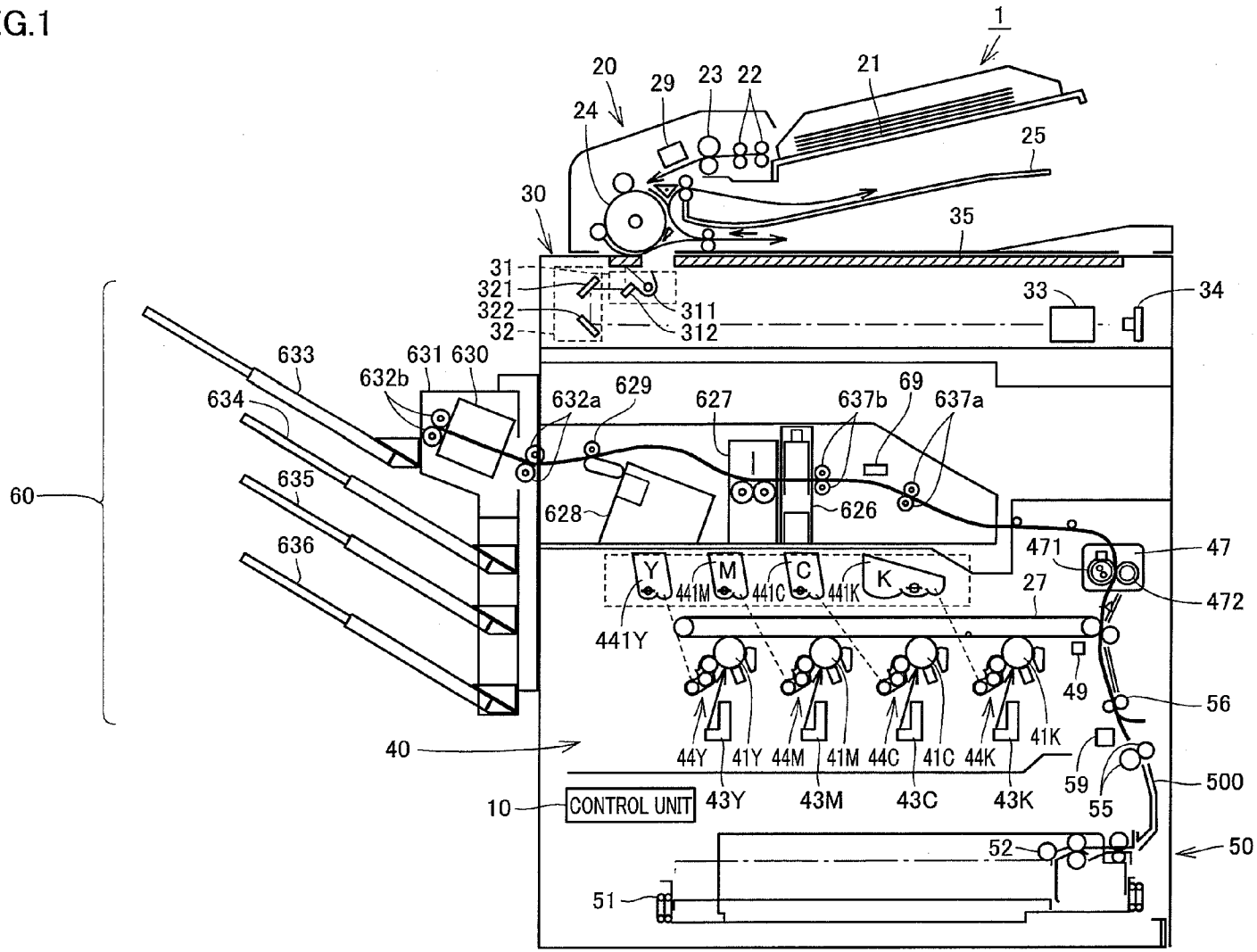
FIG. 1 schematically shows a configuration of a multi function peripheral (MFP) that is an embodiment of a sheet transportation device of the present invention.

Embodiments of the present invention will be described hereinafter with reference to the drawings. In the drawings, elements with the same function have the same reference character allotted, and description thereof will not be repeated.

1. Overall Configuration of Image Formation Apparatus

The present invention is applicable to any apparatus as long as it includes a mechanism for sheet transportation (sheet transportation device). Specifically, the present invention is applied to the so-called image formation apparatus such as a copy machine, laser printer, facsimile, multi function peripheral (MFP), an image reader device such as a scanner, and/or a post-processing device such as a finisher. As a typical example of a sheet transportation device of the present invention, a multi function peripheral that is an image formation apparatus incorporated with a plurality of functions such as a copy function, print function, facsimile function, and scanner function will be described.

FIG. 1 represents a schematic configuration of an MFP 1 as an example of a sheet transportation device of the present invention.

Referring to FIG. 1, MFP 1 includes an automatic document feeder 20, a scanner 30, a print engine 40, a sheet feeder 50, and a finisher 60.

Automatic document feeder 20 is directed to scanning documents continuously, and includes a document feed tray 21, a send-out roller 22, a resist roller 23, a transport drum 24, and a sheet discharge tray 25. A document that is the subject of scanning is placed on document feed tray 21, and fed out to the transportation path one by one through actuation of send-out roller 22. The dispatched document is temporarily stopped by resist roller 23 to have the leading edge straightened, and forwarded towards transport drum 24. Automatic document feeder 20 includes a sensor unit 29 to detect passage of a document forwarded to transport drum 24 by send-out roller 22.

The document rotates integrally on the surface of transport drum 24 to have an image thereon scanned by a scanner 30 that will be described afterwards, during the rotation. Then, the document is detached from the drum surface at a site corresponding to substantially half the circumference of the surface of transport drum 24 to be output onto sheet discharge tray 25.

Scanner 30 includes a first mirror unit 31, a second mirror unit 32, an imaging lens 33, an image sensing element 34, and a platen glass 35. First mirror unit 31 includes a light source 311 and a mirror 312 to emit light from light source 311 towards the passing document at an image scanning position immediately below transport drum 24. With regard to the light emitted from light source 311, the light reflected from the document enters second mirror unit 32. Second mirror unit 32 includes mirrors 321 and 322 arranged along a direction orthogonal to the document moving direction. The reflected light from first mirror unit 31 is sequentially reflected at mirrors 321 and 322 to be guided to imaging lens 33. Imaging lens 33 forms an image at linear image sensing elements 34 based on the reflected light.

In the case where an operator manually places a document on platen glass 35, first mirror unit 31 and second mirror unit 32 are slid such that the reflected light from the document on platen glass 35 is guided to imaging lens 33.

Image sensing element 34 converts the received reflected light into an electrical signal for output to a control unit 10 that will be described afterwards. The document image information obtained by scanner 30, i.e. the electrical signals output from image sensing element 34, are subjected to various image processing by control unit 10.

Print engine 40 is capable of full color print out, as an example of an image formation process of electrophotography. Specifically, print engine 40 includes imaging (image formation) units 44Y, 44M, 44C and 44K producing a toner image of each of the colors of yellow (Y), magenta (M), cyan (C) and black (K), respectively. Imaging units 44Y, 44M, 44C and 44K are arranged in the cited order along a mounted transfer belt 27 that is to be driven in print engine 40.

Imaging units 44Y, 44M, 44C and 44K include image write units 43Y, 43M, 43C, 43K, and photoreceptor drums 41Y, 41M, 41C, and 41K, respectively. Each of image write units 43Y, 43M, 43C, 43K includes a laser diode emitting a laser beam corresponding to each color image in the image data of interest, and a polygon mirror to divert the laser beam for exposing the surface of a corresponding one of photoreceptor drums 41Y, 41M, 41C, and 41K in the main scanning direction.

On the surface of photoreceptor drums 41Y, 41M, 41C, and 41K is formed an electrostatic latent image by the exposure through aforementioned image write units 43Y, 43M, 43C, 43K. The electrostatic latent image is developed as a toner image by toner particles supplied from a corresponding one of toner units 441Y, 441M, 441C, and 441K.

The developed toner image of each color on the surface of photoreceptor drums 41Y, 41M, 41C, and 41K is sequentially transferred (primary transfer) to transfer belt 27. Then, the toner image overlaid on transfer belt 27 is further transferred (secondary transfer) onto a recording sheet supplied in matching timing from sheet feeder 50.

The toner image transferred onto the recording sheet is fixed at a fixer device 47 located at a downstream region, and then delivered to finisher 60.

It is to be noted that the present invention is applicable to an image formation apparatus that can form only a monochrome image, and is not limited to a print engine directed to the overlapping of the toner image of full color (4 colors) set forth above.

Concurrently with the operation of imaging units 44Y, 44M, 44C and 44K, a sheet feed roller 52 provided at the sheet feed cassette of sheet feeder 50 storing recording sheets is actuated to feed out a recording sheet. The supplied recording sheet is delivered through transportation path 500 by transport roller 55 and timing roller 56 to be supplied to a transfer unit (secondary transfer unit) in synchronization with the toner image formed on transfer belt 27. Sheet feeder 50 includes a sensor unit 59 to detect whether there is a recording sheet on transportation path 500 or not.

Fixer device 47 includes a heat roller 471 and a pressure roller 472. At fixer device 47, the recording sheet is heated by heat roller 471 to have the toner transferred thereon fused, and subjected to pressure by heat roller 471 and pressure roller 472, whereby the fused toner is fixed on the recording sheet. Then, the recording sheet having the toner fixed is forwarded to finisher 60. For fixer device 47, a fixing scheme employing a fixer belt or a non-contact fixing scheme may be employed instead of the fixing scheme using a fixing roller shown in FIG. 1.

An image density control (IDC) sensor 49 detects the density of the toner image formed on transfer belt 27. IDC sensor 49 is a light intensity sensor typically constituted of a reflective type photosensor for detecting the intensity of light reflected from the surface of transfer belt 27.

Finisher 60 mainly includes a punch unit 626, a folding unit 627, a stapler 628, a center stapler 630, and a tray unit 631.

The recording sheet passing through fixer device 47 is delivered into finisher 60 via a pair of rollers 637*a* and 637*b*, At finisher 60, a sensor unit 69 detecting absence/presence of a recording sheet on the transportation path is provided.

In the neighborhood of stapler 628 are arranged a storage roller 629 to pull a recording sheet to stapler 628, and a discharge roller pair 632*a* for discharging a recording sheet onto tray unit 631. Although not shown, there is also provided a detach/contact mechanism for bringing one of rollers of discharge roller pair 632*a* towards or away from the other roller.

In the neighborhood of center stapler 630 is provided a discharge roller pair 632*b* to discharge a recording sheet from tray unit 631 to first discharge tray 633.

At finisher 60, tray unit 631 is shifted vertically to discharge a recording sheet onto any of second discharge tray 634, third discharge tray 635, and fourth discharge tray 636, in accordance with the setting. By the shifting of tray unit 631, a recording sheet is appropriately output to second discharge tray 634, third discharge tray 635, or fourth discharge tray 636 from discharge roller pair 632*a*.

At finisher 60, the recording sheet responds to the setting to be subjected to a punching process by punch unit 626, subjected to a folding process by folding unit 627, and subjected to a stapling process by stapler 628 or center stapler 630.

2. Hardware Configuration of Sheet Transportation Device

Figure 2:
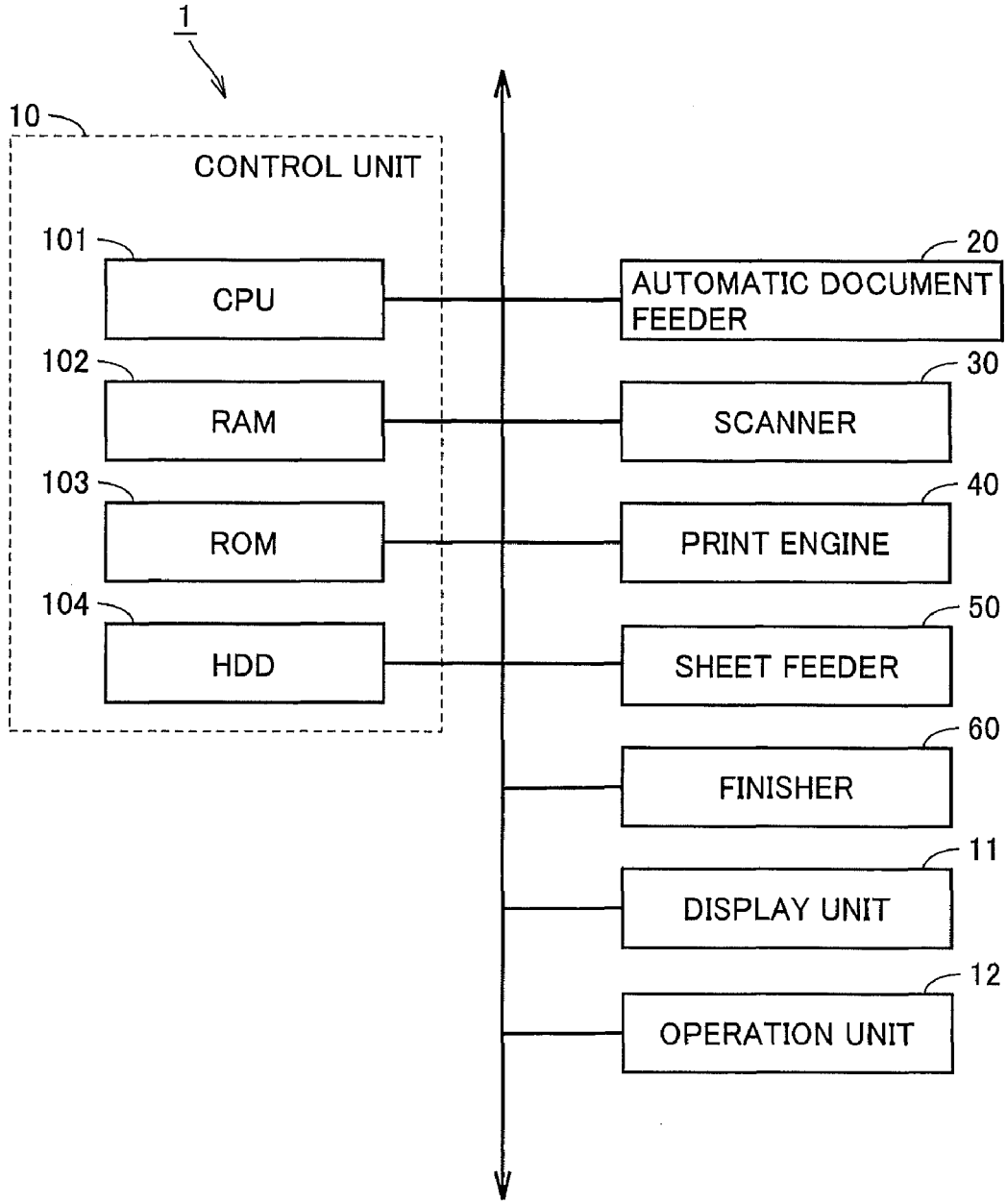
FIG. 2 is a block diagram schematically showing a hardware configuration of the MFP.

Referring to the schematic block diagram of FIG. 2, MFP 1 includes a control unit 10 for overall control of MFP 1, an automatic document feeder 20, a scanner 30, a print engine 40, a sheet feeder 50 and a finisher 60.

Control unit 10 includes a central processing unit (CPU) 101, a random access memory (RAM) 102 to temporarily store data, a read only memory (ROM) 103 to store a program, a constant, or the like for execution by CPU 101, and a hard disk drive (HDD) 104 that is a storage for storing image data and the like. Control unit 10 may include an output control unit for control on the output of a recording sheet at finisher 60, and/or a communication I/O (Input/Output) for communication with another device such as a personal computer through a network.

MFP 1 also includes a display unit 11 to display the state of MFP 1, information to support an operation, and the like, and an operation unit 12 operated when information is to be entered by the user towards MFP 1.

3. Recording Sheet Transportation Mechanism

[Schematic Illustration of Sheet Feeder]

Figure 3:
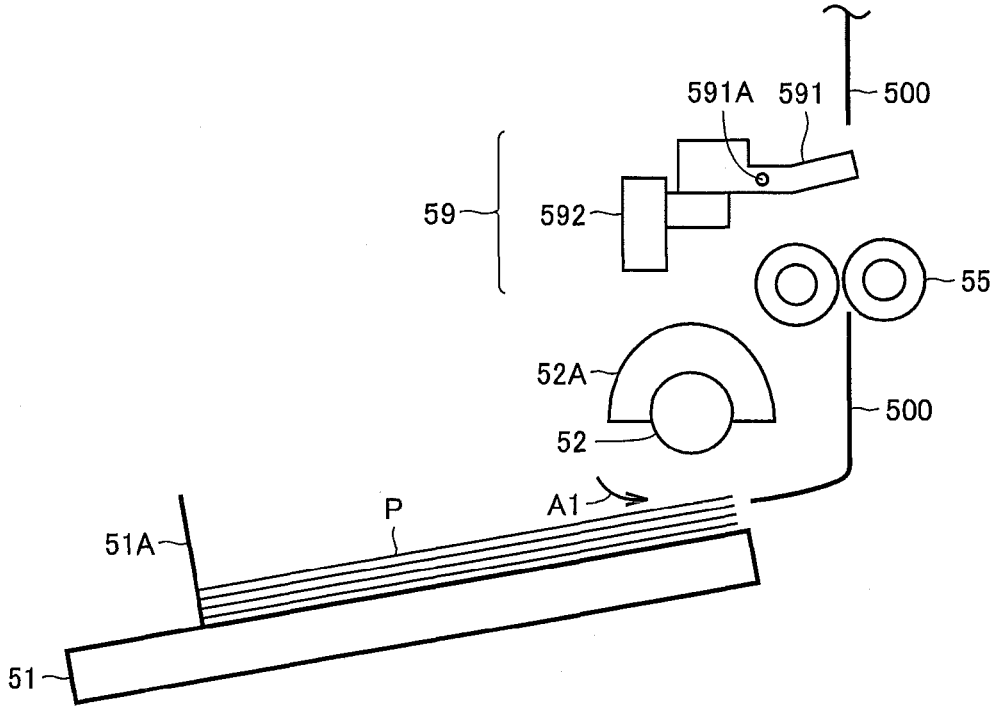
FIGS. 3, 4, and 5 schematically show a detailed configuration of a sheet feeder of the MFP.
Figure 4:
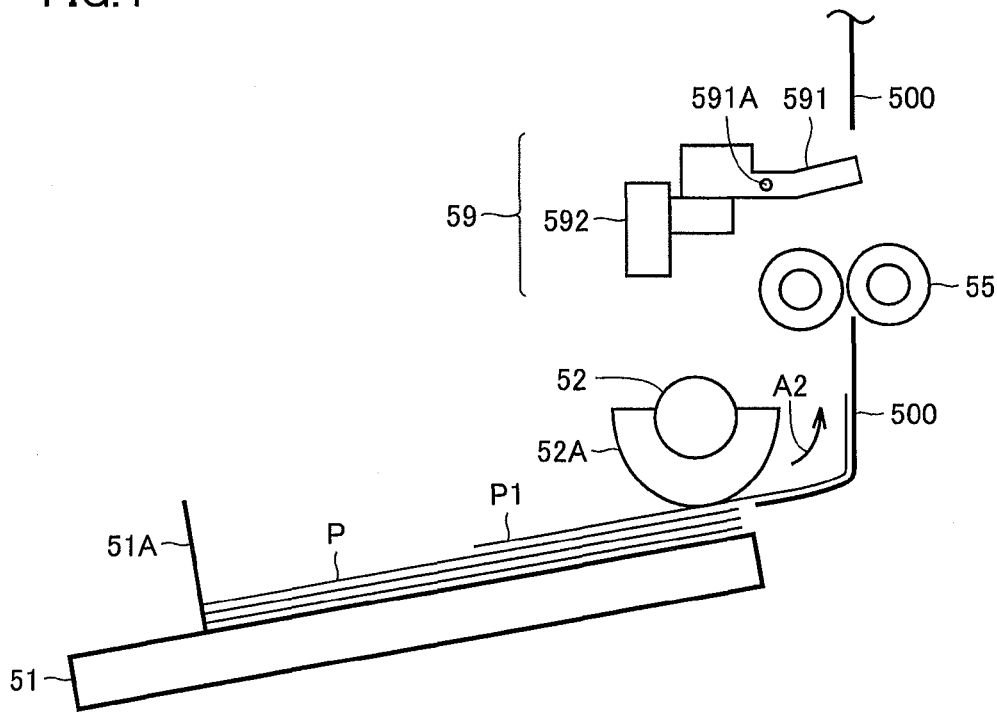
Figure 5:
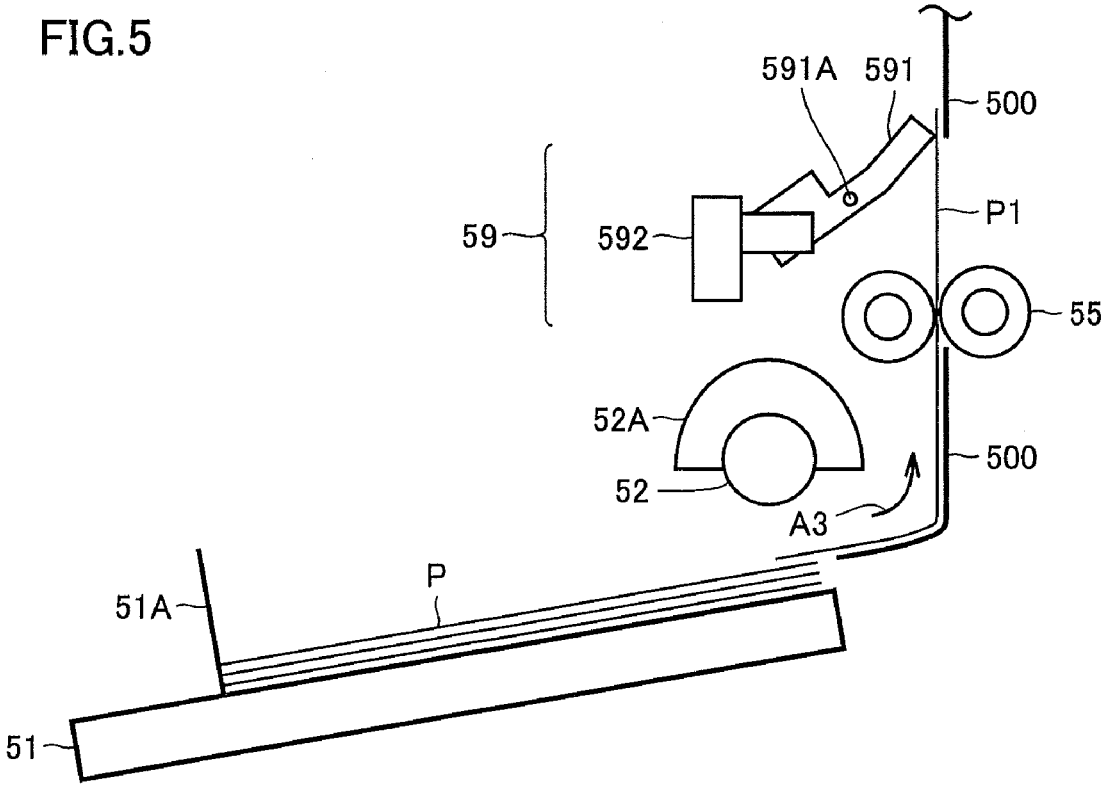

FIGS. 3-5 schematically represent a detailed configuration of sheet feeder 50 constituting the recording sheet transportation mechanism of MFP 1. FIGS. 3, 4, and 5 represent a state prior to sheet feeding, during sheet feeding, and after sheet feeding, respectively.

Referring to FIGS. 3-5, a recording sheet P is accommodated in a sheet storage unit including a recording sheet tray 51 for storing recording sheets P and a sheet regulating plate 51A regulating the trailing edge of a recording sheet. From the state shown in FIG. 3, sheet feed roller 52 is rotated in the direction of arrow A1, whereby recording sheet P forms contact with a sheet unloose member 52A which is attached on the outer circumference of sheet feed roller 52.

FIGS. 4 and 5 correspond to the state where the topmost recording sheet P1 in the sheet storage unit is delivered onto transportation path 500. By the rotation of sheet feed roller 52 in the direction of arrow A2, as shown in FIG. 4, recording sheet P1 is forwarded onto transportation path 500. Referring to FIG. 5, sheet feed roller 52 rotates in the direction of arrow A3 to return to the initial state.

Sheet feed roller 52 is configured to allow coupling with a member such as a gear. At MFP 1, the ON/OFF switching of applying current to a clutch solenoid (clutch solenoid L1 that will be described afterwards) causes switching of the coupling/coupling release state between sheet feed roller 52 and a member such as the gear. When sheet feed roller 52 is coupled with a member such as the gear, the rotation force from the motor (motor 520 that will be described afterwards) is transmitted. When the coupling with the aforementioned member such as a gear is released, the rotation force from the motor is not received.

Transport roller 55 for transportation of recording sheet P1 is provided at transportation path 500. Transport roller 55 is rotated upon receiving the rotation force of the motor (not shown), whereby recording sheet P1 is delivered further in the downstream direction.

Further downstream of transport roller 55 in transportation path 500, sensor unit 59 to detect absence/presence of recording sheet P1 is provided. Sensor unit 59 includes a sheet detection lever 591 and a photosensor 592. Photosensor 592 includes a light-emitting element and light-receiving element that will be described afterwards (light-emitting element 592A and light-receiving element 592B).

Upon abutment of recording sheet P against sheet detection lever 591, sheet detection lever 591 is rotated about a shaft 591A, as shown in FIG. 5. The rotation of sheet detection lever 591 causes change in the electrical state of photosensor 592.

Based on such change in the electric state of photosensor 592, detection can be made of the absence/presence of recording sheet P at a detecting position by sensor unit 59 on transportation path 500. At MFP 1, detection is made that the leading edge of recording sheet P has arrived at the detecting position by sensor unit 59 through the start of change in the electrical state, and detection can be made that the trailing edge of recording sheet P has passed the detecting position by sensor unit 59 through the end of change in the electrical state. Photosensor 592 is constituted of a transmissive photosensor or reflective photosensor, for example.

[Circuit Configuration of Sheet Feeder]

Figure 6:
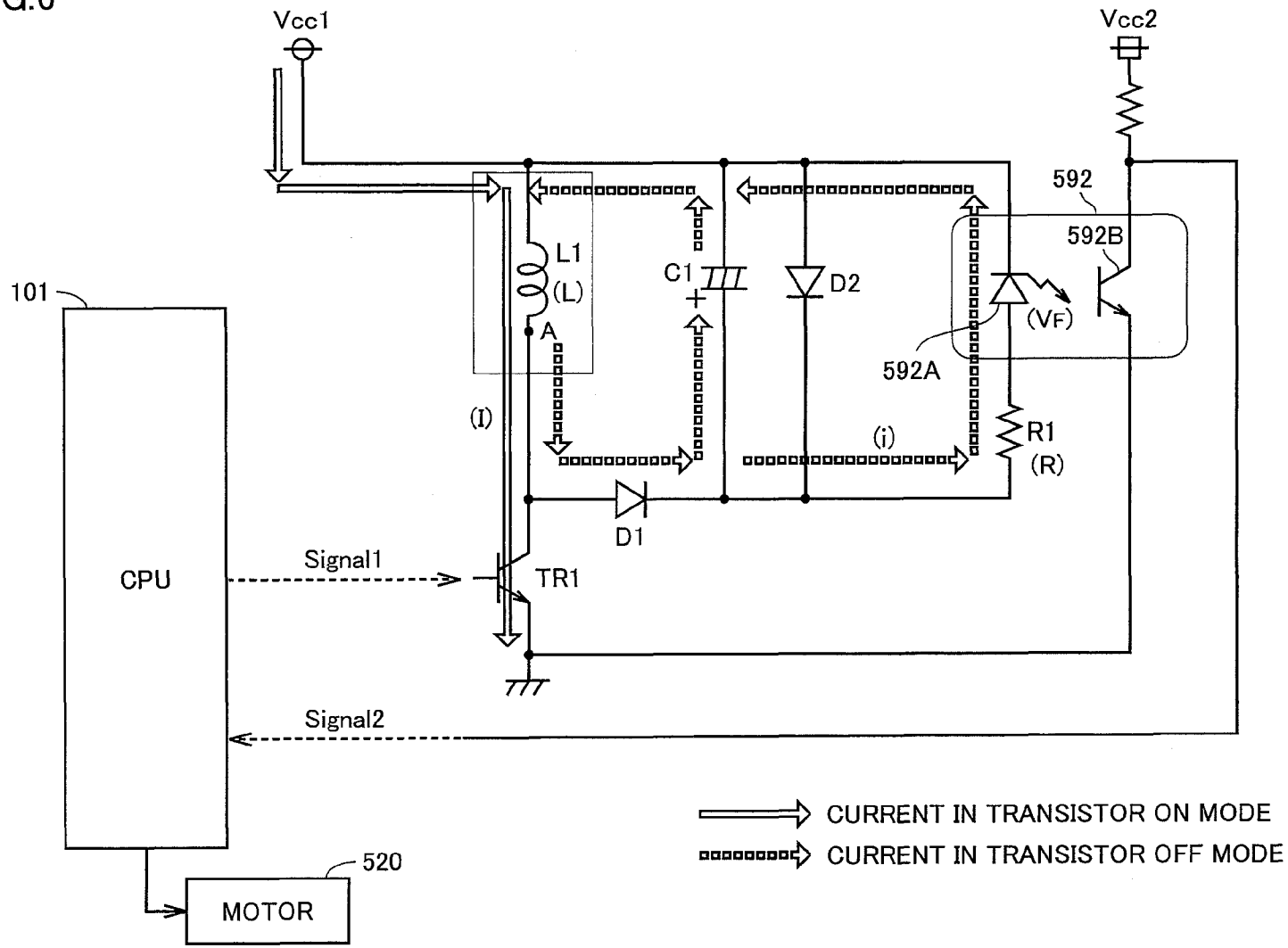
FIG. 6 is a circuit diagram directed to using counter electromotive force of an electromagnetic component at the sheet feeder of the MFP as the source of electric power for a detector.

FIG. 6 is a circuit diagram directed to using the counter electromotive force of an electromagnetic component at sheet feeder 50 as the source of electric power for photosensor 592 that is a detector.

Referring to FIG. 6, the switching of transistor TR1 to an ON state causes current to be applied to clutch solenoid L1 from a direct current power supply Vcc1, whereby clutch solenoid L1 is excited at MFP 1. Excitation of clutch solenoid L1 corresponds to the state in which sheet feed roller 52 is coupled with a member such as a gear. Motor 520 is the driving source of sheet feed roller 52, and functions to apply rotation force to sheet feed roller 52. Therefore, when transistor TR1 is turned ON with motor 520 in an ON state, the rotation force of motor 520 is transmitted to sheet feed roller 52. Accordingly, sheet feed roller 52 is rotated, whereby recording sheet P in the sheet storage unit is transferred to transportation path 500. In FIG. 6, the current flow during excitation of clutch solenoid L1 is represented by the open arrow.

At MFP 1, transistor TR1 is turned ON in response to CPU 101 providing a remote signal Signal1 of high level (for example, a voltage signal of 5V) to transistor TR1.

When CPU 101 outputs Signal1 of low level (for example, a voltage signal of 0V), transistor TR1 is turned OFF. By turning off transistor TR1 from an ON state, counter electromotive force is induced at clutch solenoid L1, whereby the voltage at point A becomes higher than the level of direct current power supply Vcc1.

In FIG. 6, the current flow when transistor TR1 is turned OFF from an ON state is represented by the broken line arrow.

Since the transition of transistor TR1 from an ON state to an OFF state causes the voltage at point A to become higher than direct current power supply Vcc1 due to the counter electromotive force induced at clutch solenoid L1, an electrolytic capacitor C1 for smoothing is charged through a rectify diode D1. The electric power charged to smoothing electrolytic capacitor C1 is supplied to a resistor R1 connected parallel to smoothing electrolytic capacitor C1 and the element at the light emitting side (light-emitting element 592A) of photosensor 592 that is a detector. This flow of current to light-emitting element 592A causes the relevant light-emitting element 592A to generate light, whereby photosensor 592 will start to operate. Diode D2 is provided to prevent reverse voltage from being applied to smoothing electrolytic capacitor C1 under an OFF state of transistor TR1.

Although a photosensor 592 including light-emitting element 592A and light-receiving element 592B is employed as a detector in the present embodiment, the specific configuration of the detector in the present invention is not limited thereto. Any means may be employed as long as detection of the absence/presence of a sheet can be made by the supply of induced counter electromotive force at the clutch solenoid that is an electromagnetic component.

[Operating Timing of Sheet Feeder in Recording Sheet Transportation Mode]

Figure 7:
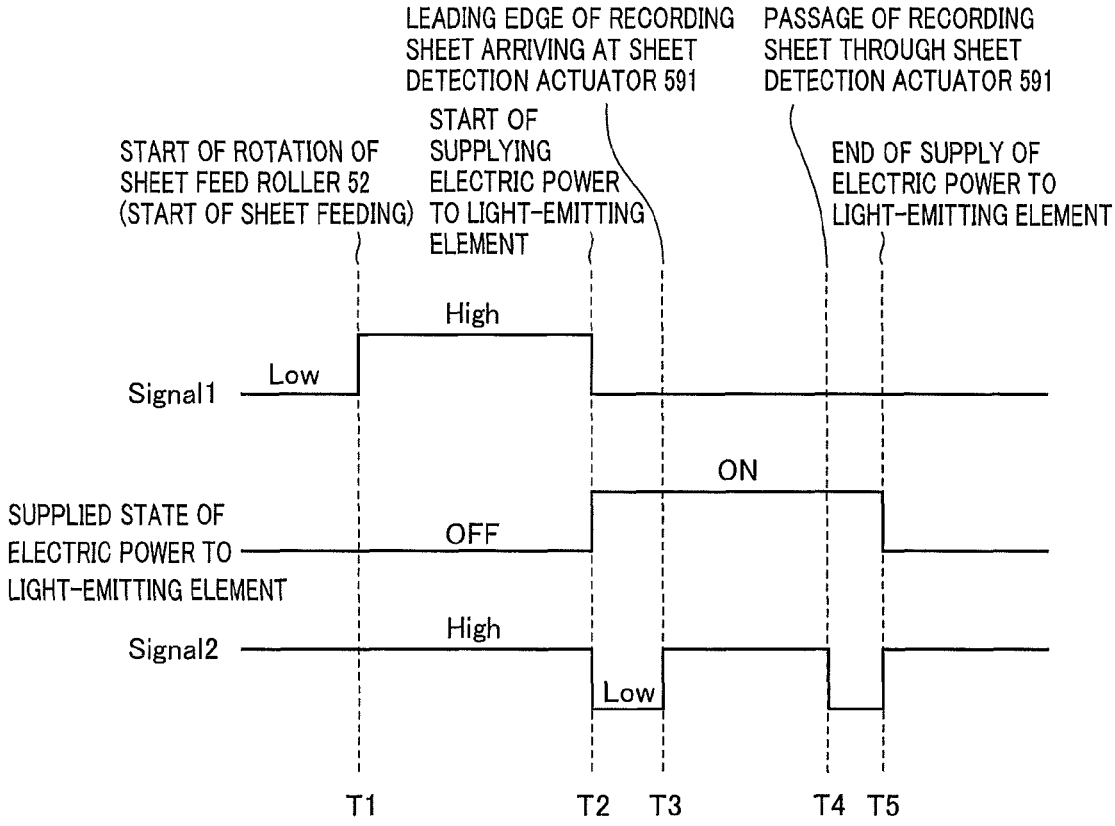
FIG. 7 is a timing chart representing the ON/OFF timing of an electromagnetic component and operation timing of a detector in a transportation mode of a recording sheet at the MFP.

FIG. 7 is a timing chart representing the ON/OFF timing of an electromagnetic component (clutch solenoid L1) and the operating timing of a detector (photosensor 592) in a transportation mode of a recording sheet at MFP 1. FIG. 7 shows, from the upper side, the state of Signal1, the supplied state of counter electromotive force to light-emitting element 592A, and the state of a detection signal (Signal2) from light-receiving element 592B towards CPU 101. Light-receiving element 592B receives electric power from direct current power supply Vcc2, and outputs a low level signal and a high level signal as Signal2 to CPU 101 when receiving and not receiving, respectively, the light generated from light-emitting element 592A.

Referring to FIG. 7, sheet feed roller 52 is rotated to supply a recording sheet P onto transportation path 500 at MFP 1. Specifically, CPU 101 outputs a high level Signal1 to transistor TR1 from time T1 to time T2. It is to be noted that CPU 101 has motor 520 turned ON prior to time T1. Therefore, the rotation force of motor 520 is transmitted to sheet feed roller 52 during an high level output period of Signal1, whereby the recording sheet in the sheet storage unit is output onto transportation path 500, as described with reference to FIGS. 3-5.

When Signal1 is switched from high level to low level at time T2, the counter electromotive force induced at clutch solenoid L1 is supplied to light-emitting element 592A. Accordingly, the electric power supply state towards light-emitting element 592A, corresponding to the second stage in FIG. 7, is switched from an OFF state to an ON state at time T2. By the start of supplying electric power to light-emitting element 592A, light-receiving element 592B receives the light generated by light-emitting element 592A, whereby Signal2 is switched from high level to low level at time T2.

Meanwhile, recording sheet P transferred to transportation path 500 by the rotation of sheet feed roller 52 arrives at the detecting position by sensor unit 59, causing sheet detection lever 591 to be turned.

FIG. 7 represents an example where the leading edge of the recording sheet arrives at the detecting position by sensor unit 59 to cause sheet detection lever 591 to be turned at time T3. The arrival of the leading edge of a recording sheet at the detecting position by sensor unit 59 at time T3 causes sheet detection lever 591 to be turned, as shown in FIG. 5, whereby light-receiving element 592B cannot receive the light generated from light-emitting element 592A. Accordingly, Signal2 is switched from low level to high level at time T3.

FIG. 7 corresponds to an example where recording sheet P arriving at the detecting position by sensor unit 59 at time T3 passes the detecting position by sensor unit 59 at time T4. By the passage of the trailing edge of recording sheet P through the detecting position by sensor unit 59 at time T4, the turned state of sheet detection lever 591 (refer to FIG. 5) returns to the initial state. This return of the turned state to the initial state allows light-receiving element 592B to receive the light generated by light-emitting element 592A. Thus, Signal2 is switched from high level to low level at time T4.

FIG. 7 represents the example where the counter electromotive force of clutch solenoid L1 is supplied to light-emitting element 592A until time T5. Namely, referring to the second stage in FIG. 7, the electric power supply state to light-emitting element 592A is switched to OFF at time T5. When supply of the counter electromotive force to light-emitting element 592A ends at time T5, light-receiving element 592B will no longer receive light generated from light-emitting element 592A. Accordingly, the output Signal2 is switched from low level to high level at time T5.

At MFP 1, the transportation speed of recording sheet P is determined in advance, and the distance from sheet feed roller 52 to the detecting position by sensor unit 59 is constant. Therefore, the time starting from the switching of Signal1 from low level to high level (T1) up to a point of time when the leading edge of the transported recording sheet arrives at the detecting position by sensor unit 59 (T3) is substantially constant.

CPU 101 obtains in advance the reference value for a period of time, starting from the switching of Signal1 from low level to high level until arrival of the leading edge of recording sheet P at a detecting position by sensor unit 59, based on the transportation speed and the like of recording sheet P.

When Signal2 is not switched from low level to high level even at an elapse of the time of the reference value from the switching of Signal1 from low level to high level, CPU 101 determines that an error has occurred in the transportation of the recording sheet (jamming or the like), and outputs an error signal or notifies that an error has occurred. For example, CPU 101 provides a display of a predetermined message at display unit 11 to notify an error.

It is to be noted that, when the transportation speed of recording sheet P is determined in advance, and the distance from sheet feed roller 52 to the detecting position by sensor unit 59 is constant, the time starting from the point of time (T2) when Signal1 is switched from high level to low level until the above-described T3 is substantially constant. Therefore, the reference value for the time in the determination of the occurrence of an error by CPU 101 may be set in association with time starting from the switching of Signal1 from high level to low level until the arrival of the leading edge of the recording sheet at the detecting position by sensor unit 59. In this case, when Signal2 is not switched from low level to high level even at an elapse of the time of the reference value from the switching of Signal1 from high level to low level, CPU 101 outputs an error signal, or informs that an error is occurring.

[Condition for Taking Counter Electromotive Force as Electric Power Source]

In the present embodiment described above, the counter electromotive force induced when clutch solenoid L1 that is ON for transportation of a recording sheet is turned OFF is utilized as the electric power source of light-emitting element 592A that generates light to detect absence/presence of a recording sheet in transportation path 500.

In order to ensure detection of recording sheet P on transportation path 500 by means of light-emitting element 592A, light-emitting element 592A must be lit at least during a period starting from clutch solenoid L1 being turned OFF until the passage of the trailing edge of recording sheet P at the detecting position by sensor unit 59. A quantitative evaluation for such a condition will be described hereinafter with reference to FIG. 8.

Referring to FIG. 8, energy J of the counter electromotive force induced at point A of clutch solenoid L1 is represented by equation (1) in FIG. 8, where "L" is the self-inductance of clutch solenoid L1, and "I" is the value of current flowing through clutch solenoid L1 by the supply of electric power from direct current power supply Vcc1.

The electric power consumed at the circuit including photosensor 592 is represented as the sum of the power consumption by resistor R1 and the power consumption by light-emitting element 592A. Therefore, electric power W consumed at the aforementioned circuit is represented by equation (2) in FIG. 8, where "i" is the value of the current flowing through the relevant circuit, "R" is the resistance of resistor R1, and "$V_F$" is the voltage applied to light-emitting element 592A.

Here, the relationship of "W=J×t" is established, where "t" is the period of time of the current flowing through the circuit including photosensor 592. Therefore, equation (3) is established based on equation (1) and equation (2), whereby "t" is obtained, as indicated by equation (4).

The aforementioned "t" is relevant to the length of the period of time electric power is supplied to light-emitting element 592A, i.e. the length of time of light-emitting element 592A being lit by the supply of counter electromotive force.

The period of time starting from clutch solenoid L1 being turned OFF until the trailing edge of recording sheet P arrives at the detecting position by sensor unit 59 on transportation path 500 depends upon the distance between sheet feed roller 52 and the detecting position by sensor unit 59 along transportation path 500, and the transportation speed of recording sheet P.

Thus, in order to use the counter electromotive force induced at clutch solenoid L1 as the driving force of light-emitting element 592A in MFP 1, the time (T) before the trailing edge of recording sheet P passes the detecting position by sensor unit 59 is calculated. Then, the self-inductance of clutch solenoid L1, the value of current supplied to clutch solenoid L1 from direct current power supply Vcc1, and the like are selected such that "t" in equation (4) exceeds T.

The aforementioned "T" is obtained by calculating the time for the trailing edge of recording sheet P to arrive at the detecting position by sensor unit 59, and adding, to the calculated time, the period of time starting from the leading edge of recording sheet P arriving at the detecting position by sensor unit 59 until the passage of the trailing edge of recording sheet P through the detecting position by sensor unit 59. The period of time starting from the arrival of the leading edge of recording edge P at the detecting position by sensor unit 59 until the passage of the trailing edge of recording sheet P through the detecting position by sensor unit 59 can be obtained by the dimension of recording sheet P in the transportation direction and the transportation speed of recording sheet P.

The length from T3 to T4 in FIG. 7, i.e. the length of a period of time starting from the switching of Signal2 from low level to high level until the switching to low level again, depends upon the transportation speed of the recording sheet and the length of the recording sheet in the transportation direction. Therefore, CPU 101 can detect whether the sheet size of the recording sheet delivered to transportation path 500 is appropriate or not based on the transportation speed of the recording sheet, and the period of time of Signal2 switched to high level from a low level state and then again to low level. To carry out such a determination, "t" in equation (4) is set with respect to light-emitting element 592A such that the counter electromotive force of clutch solenoid L1 is supplied for a duration exceeding the period of time starting from Signal1 rendered low until the passage of the recording sheet through sheet detection lever 591. As such, the self-inductance and the like of clutch solenoid L1 must be selected.

In the case where detection of the passage of the trailing edge of recording sheet P through the detecting position by sensor unit 59 is not required at MFP 1, and only detection of the arrival of the leading edge of recording sheet P at the detecting position by sensor unit 59 is required, the aforementioned time "T" may be the time for the leading edge of recording sheet P to arrive at the detecting position by sensor unit 59.

[Sheet Feeder Operation Timing in Operation Confirmation Mode]

At MFP 1, operation confirmation is made, at the time of turning ON the power and/or at the time of returning from a jamming state, to confirm that sensor unit 59 is operating properly and/or recording sheet P on transportation path 500 (causing jamming) has been removed. This operation confirmation is made by temporal excitation of clutch solenoid L1 without rotation of sheet feed roller 52, followed by determination of an output from photosensor 592 when excitation of clutch solenoid L1 is stopped.

Figure 9:
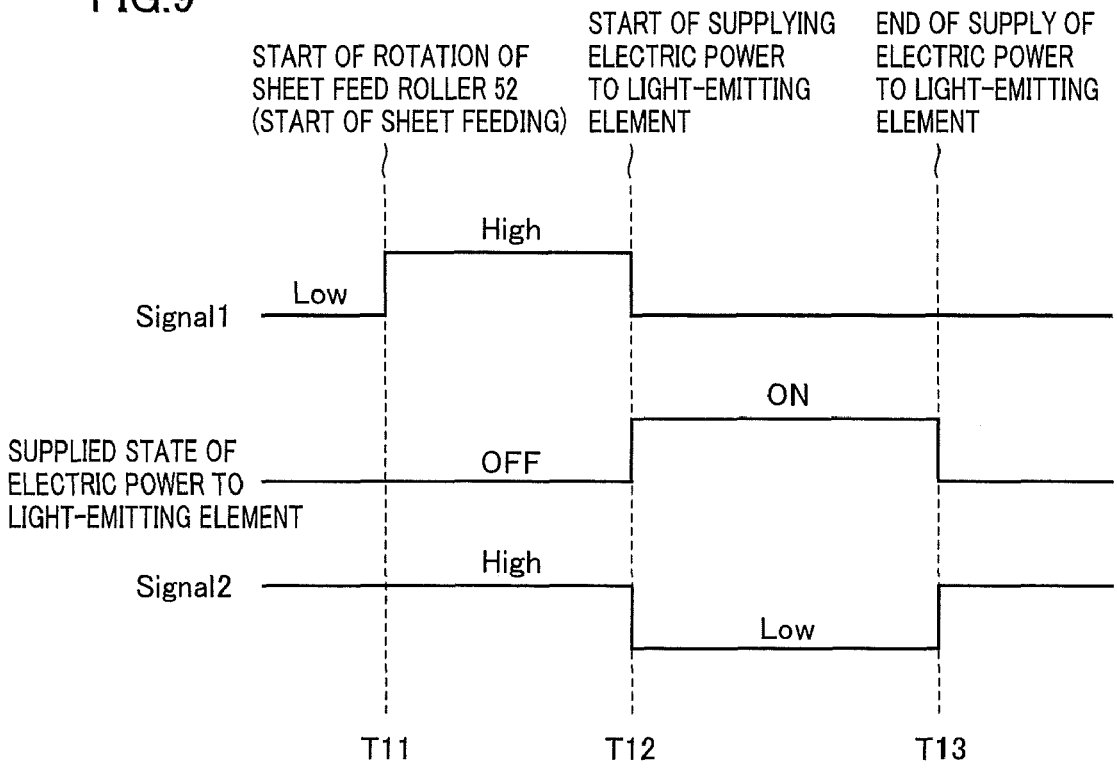
FIG. 9 is a timing chart representing the ON/OFF timing of an electromagnetic component at the sheet feeder and operation timing of the detector in an operation confirmation mode of the MFP.

FIG. 9 is a timing chart representing the ON/OFF timing of an electromagnetic component at the sheet feeder and operation timing of the detector in an operation confirmation mode of the MFP. Likewise with FIG. 7, FIG. 9 shows, from the upper side, the state of Signal1, the supplied state of counter electromotive force to light-emitting element 592A, and the state of a detection signal (Signal2) from light-receiving element 592B towards CPU 101. In an operation confirmation mode, CPU 101 does not apply current to motor 520. Accordingly, Signal1 of high level is output, and sheet feed roller 52 is not rotated even if clutch solenoid L1 is turned ON in an operation confirmation mode.

Referring to FIG. 9 corresponding to an operation confirmation mode, CPU 101 outputs Signal1 of high level from time T11 to T12, and then switches Signal1 to low level. Accordingly, counter electromotive force is induced at clutch solenoid L1 at time T12. Therefore, the electric power supply state to light-emitting element 592A is switched from OFF to ON at time T12. In response, light-receiving element 592B begins to receive the light generated by light-emitting element 592A, whereby Signal2 is switched from high level to low level at time T12.

In the example of FIG. 9, the counter electromotive force of clutch solenoid L1 is supplied to light-emitting element 592A from time T12 to time T13. Accordingly, the electric power supply state to light-emitting element 592A is switched OFF at time T13. The output of Signal2 is switched from low level to high level.

FIG. 9 is a timing chart when proper operation is executed.

In the case where light-emitting element 592A is damaged so that light is not generated, light-emitting element 592A cannot emit light even if CPU 101 outputs Signal1 of high level. Accordingly, the output of Signal2 is not switched to low level, and remains high. Thus, when the output of Signal2 is not switched to low level even if a predetermined time elapses from the switching of Signal1 to low level, CPU 101 notifies an error, CPU 101 notifies an error by providing a predetermined message at display unit 11, for example.

Even if light-emitting element 592A generates light, Signal2 will remain low in the case where sheet detection lever 591 takes a turned state, as shown in FIG. 5, due to a recording sheet P being stuck, for example, in transportation path 500. Thus, CPU 101 notifies an error when the output Signal2 is not switched from high level to low level at an appropriate timing. Therefore, in the case where Signal2 remains low due to a sheet being stuck, for example, and is not switched from high level to low level at an appropriate timing, an error is notified by CPU 101.

[Summarization of Operation of Recording Sheet Transportation Mechanism]

In the present embodiment set forth above, the transportation unit is constituted of sheet feed roller 52 transporting a recording sheet along transportation path 500 in response to application of current to clutch solenoid L1.

The detection unit is constituted of photosensor 592 arranged downstream of sheet feed roller 52 in transportation path 500 for detecting absence/presence of a recording sheet in transportation path 500.

The supply unit supplying the counter electromotive force induced at an electromagnetic component as the electric power for a detector is constituted of rectify diode D1, capacitor C1, diode D2 and resistor R1 (refer to FIG. 6) provided to send the counter electromotive force induced at clutch solenoid L1 to light-emitting element 592A without reverse flow.

In the present embodiment, the electromagnetic component is not limited to clutch solenoid L1. In the case where MFP 1 is absent of clutch solenoid L1, and sheet feed roller 52 is directly coupled with motor 520, application of current to motor 520 is initiated when rotation of sheet feed roller 52 is started, and application of current to motor 520 is stopped when the rotation is ceased. MFP 1 may be configured such that the counter electromotive force induced at motor 520 is supplied to light-emitting element 592A in response to stopping the application of current to motor 520 by having motor 520 connected instead of clutch solenoid L1 of FIG. 6, for example.

Further, the counter electromotive force induced at clutch solenoid L1 is rectified by rectify diode D1, and then delivered to light-emitting element 592A via resistor R1. Accordingly, when current is applied to clutch solenoid L1 for rotation of sheet feed roller 52 to transport a recording sheet, the counter electromotive force induced by stopping the application of current is supplied to light-emitting element 592A at a timing allowing detection of passage of the relevant recording sheet through transportation path 500.

As described with reference to FIG. 8, the resistance value of resistor R1 is set such that the aforementioned "t" exceeds "T". Accordingly, the property of the supply unit is determined such that electric power is supplied to the detector at least until the trailing edge of the sheet passes the detecting position by the detector.

In the present embodiment, light-emitting element 592A receiving supply of the counter electromotive force is provided downstream of sheet feed roller 52 in the transportation direction of the recording sheet. Accordingly, after application of current to an electromagnetic component (clutch solenoid) is initiated and then stopped in the transportation mode of a recording sheet, detection of the recording sheet will be made by the detector (photosensor). Since the counter electromotive force induced by stopping application of current to the electromagnetic component can be promptly used for the detection operation by the detector, an additional mechanism to store the counter electromotive force does not have to be provided, allowing effective usage of the counter electromotive force.

In a normal image formation mode of MFP 1, motor 520 is rotated and current is applied to clutch solenoid L1, whereby the rotation force is transmitted to sheet feed roller 52. In an operation confirmation mode, current is not applied to motor 520. Therefore, even if current is applied to clutch solenoid L1, the rotation force of motor 520 will not be transmitted to sheet feed roller 52, disallowing rotation of sheet feed roller 52. Thus, in the present embodiment, control of a first state and a second state is realized by the control unit constituted of CPU 101. In the first state, force is transmitted to the member in a state where current is applied to the electromagnetic component. In the second state, force is not transmitted to the member in a state where current is applied to the electromagnetic component.

4. Document Transportation Mechanism

The present embodiment set forth above is based on a configuration in which the counter electromotive force induced at an electromagnetic component is supplied to a component (detector) for detecting recording sheet P in transportation path 500, according to the recording sheet transportation mechanism at sheet feeder 50.

At MFP 1, the counter electromotive force induced at the electromagnetic component utilized in the transportation of a document (sheet) can be supplied to a component (detector) for detecting a document on a transportation path at automatic document feeder 20.

At automatic document feeder 20, a document on document feed tray 21 is sent out onto the transportation path by rotation of send-out roller 22. This document is detected by sensor unit 29.

Figure 10:
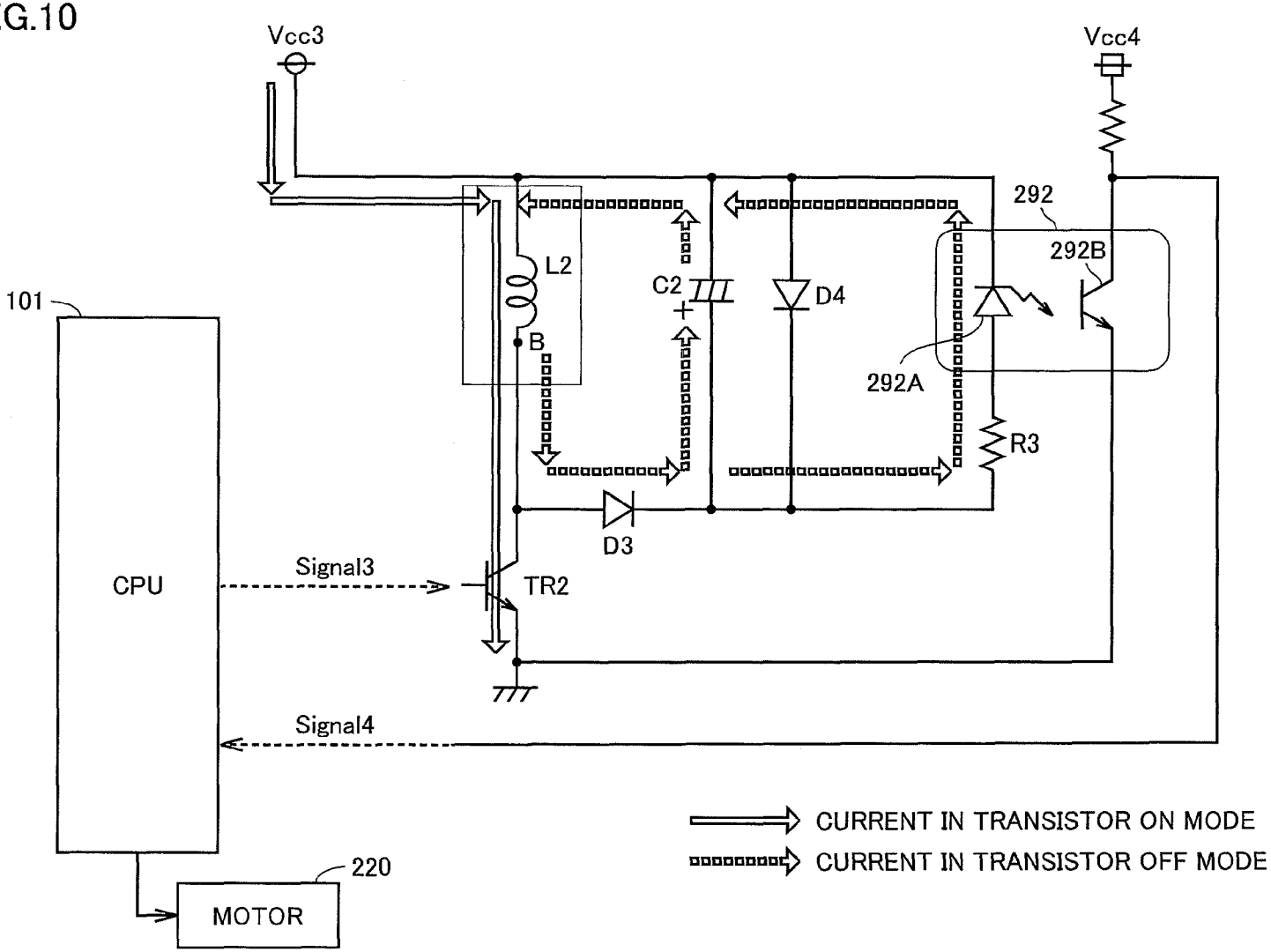
FIG. 10 is a circuit diagram directed to using counter electromotive force of an electromagnetic component at an automatic document feeder of the MFP as the driving source for the detector.

FIG. 10 is a circuit diagram directed to utilizing the counter electromotive force of an electromagnetic component (clutch solenoid L2) at automatic document feeder 20 as the electric power source of the detector (photosensor 292 in sensor unit 29).

Referring to FIG. 10, the transition of transistor TR2 to ON at automatic document feeder 20 causes current to be applied to clutch solenoid L2 from direct current power supply Vcc3, whereby clutch solenoid L2 is excited. Excitation of clutch solenoid L2 establishes a coupled state between send-out roller 22 and a member such as a gear. Motor 220 functions to apply rotation force to send-out roller 22. When transistor TR2 is turned ON in an ON state of motor 220, the rotation force of motor 220 is transmitted to send-out roller 22. Accordingly, send-out roller 22 is rotated to cause a document on document feed tray 21 to be sent to the transportation path.

In FIG. 10, the flow of current in an excitation mode of clutch solenoid L2 is represented by an open arrow.

Sensor unit 29 includes, for example, photosensor 292. Photosensor 292 includes light-emitting element 292A and light-receiving element 292B.

At automatic document feeder 20, transistor TR2 is turned ON in response to CPU 101 providing a remote signal Signal3 of high level to transistor TR2.

When CPU 101 outputs Signal3 of low level to transistor TR2, transistor TR2 is turned OFF. The transition of transistor TR2 from ON to OFF causes generation of counter electromotive force at clutch solenoid L2, whereby the voltage at point B becomes higher than the level of direct current power supply Vcc3.

In FIG. 10, the flow of current at the transition of transistor TR2 from ON to OFF is indicated by the broken line arrow.

Since the voltage at point B becomes higher than the level of direct current power supply Vcc3 due to the counter electromotive force induced at clutch solenoid L2 in response to the transition of transistor TR2 from ON to OFF, smoothing electrolytic capacitor C2 is charged via rectify diode D3. The electric power charged to smoothing electrolytic capacitor C2 is supplied to a resistor R3 connected parallel to smoothing electrolytic capacitor C2 and the element at the light emitting side (light-emitting element 292A) of photosensor 292 that is a detector. This flow of current to light-emitting element 292A causes the relevant light-emitting element 292A to generate light, whereby photosensor 292 will start to operate. Diode D4 is provided to prevent reverse voltage from being applied to smoothing electrolytic capacitor C2 under an OFF state of transistor TR2.

Comparing automatic document feeder 20 of FIG. 10 with sheet feeder 50 described with reference to FIG. 6, transistor TR2 corresponds to transistor TR1, clutch solenoid L2 corresponds to clutch solenoid L1, light-emitting element 292A corresponds to light-emitting element 592A, and light-receiving element 292B corresponds to light-receiving element 592B.

[Operation Timing of Automatic Document Feeder in Document Transportation Mode]

Figure 11:
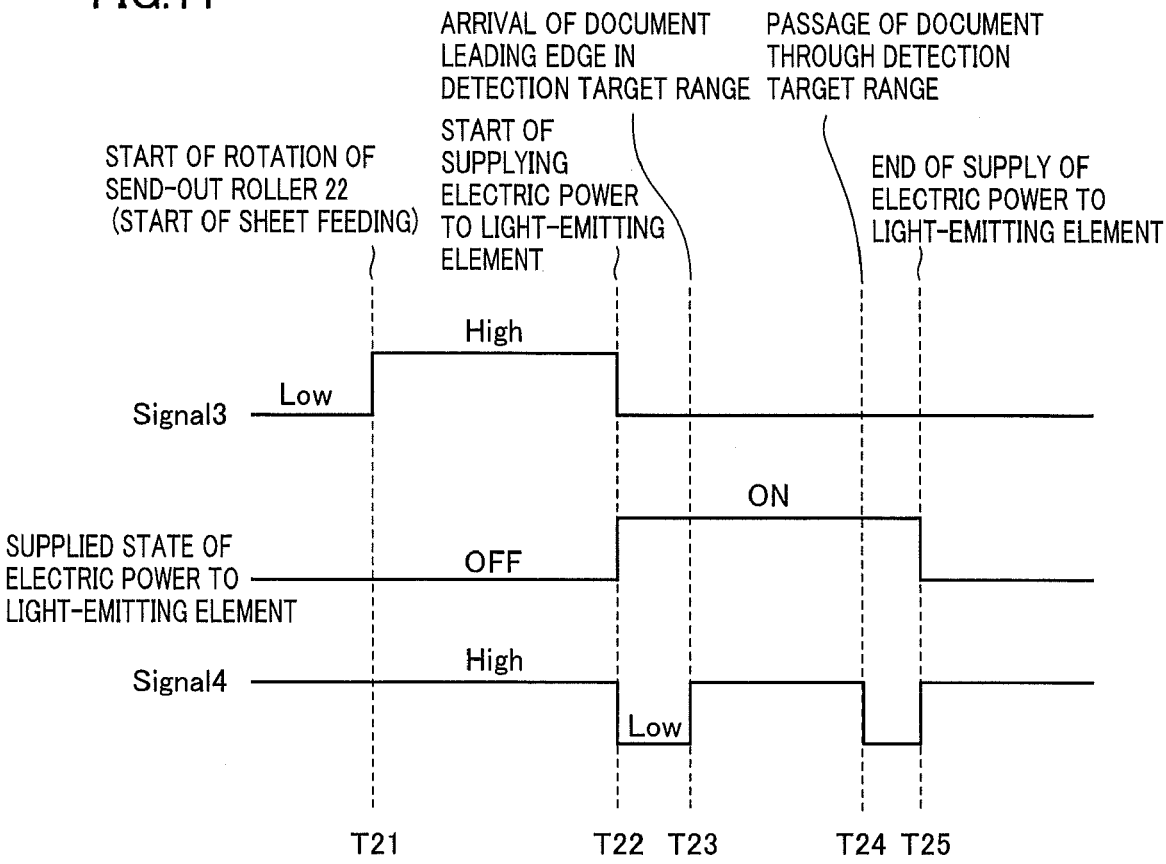
FIG. 11 is a timing chart representing the ON/OFF timing of an electromagnetic component and the operation timing of a detector in a document transportation mode of the MFP.

FIG. 11 is a timing chart representing the ON/OFF timing of an electromagnetic component (clutch solenoid L2) and the operating timing of a detector (photosensor 292) in a transportation mode of a document at automatic document feeder 20. FIG. 11 shows, from the upper side, the state of Signal3, the supplied state of counter electromotive force to light-emitting element 292A, and the state of a detection signal (Signal4) from light-receiving element 292B towards CPU 101. Light-receiving element 292B receives electric power from direct current power supply Vcc4, and outputs a low level signal and a high level signal as Signal4 to CPU 101 when receiving and not receiving, respectively, the light generated from light-emitting element 292A.

Referring to FIG. 11, CPU 101 outputs a high level Signal3 to transistor TR2 from time T21 to time T22. It is to be noted that CPU 101 has motor 220 turned ON prior to time T21. Therefore, the rotation force of motor 220 is transmitted to send-out roller 22 during an high level output period of Signal3, whereby the document on document feed tray 21 is output onto the transportation path.

When Signal3 is switched from high level to low level at time T22, the counter electromotive force induced at clutch solenoid L2 is supplied to light-emitting element 292A. Accordingly, the electric power supply state towards light-emitting element 292A, corresponding to the second stage in FIG. 9, is switched from an OFF state to an ON state at time T22. By the start of supplying electric power to light-emitting element 292A, light-receiving element 292B receives the light generated by light-emitting element 292A, whereby Signal4 is switched from high level to low level at time T22.

Meanwhile, the document transferred to the transportation path by the rotation of send-out roller 22 attains a state preventing light-receiving element 292B from receiving the light generated by light-emitting element 292A.

FIG. 11 represents an example where the leading edge of the document arrives at the detecting position by sensor unit 29 to prevent light reception at time T23. The arrival of the leading edge of the document at the detecting position by sensor unit 29 at time T23 prevents light-receiving element 292B from receiving the light generated by light-emitting element 292A. Accordingly, Signal4 is switched from low level to high level at time T23.

FIG. 11 corresponds to an example where the document arriving at the detecting position by sensor unit 29 at time T23 passes the detecting position by sensor unit 29 at time T24. By the passage of the document through the detecting position by sensor unit 29 at time T24, light-receiving element 292B attains a state allowing reception of the light generated by light-emitting element 292A. Thus, Signal4 is switched from high level to low level at time T24.

FIG. 11 represents the example where the counter electromotive force of clutch solenoid L2 is supplied to light-emitting element 292A until time T25. Namely, referring to the second stage in FIG. 11, the drive source supply state to light-emitting element 292A is switched to OFF at time T25. When supply of the counter electromotive force to light-emitting element 292A ends at time T25, light-receiving element 292B will not be able to receive light generated from light-emitting element 292A. Accordingly, the output Signal4 is switched from low level to high level at time T25.

At automatic document feeder 20, the document transportation speed is determined in advance, and the distance from send-out roller 22 to the detecting position by sensor unit 29 is constant. Therefore, the time starting from the switching of Signal3 from low level to high level (T21) up to a point of time when the leading edge of the transported document arrives at the detecting position by sensor unit 29 (T23) is substantially constant.

CPU 101 obtains in advance the reference value for a period of time, starting from the switching of Signal3 from low level to high level until arrival of the leading edge of the document at the detecting position by sensor unit 29, based on the transportation speed and the like of the document.

When Signal4 is not switched from low level to high level even at an elapse of the time of the reference value from the switching of Signal3 from low level to high level, CPU 101 determines that an error has occurred in the transportation of the document (jamming or the like), and outputs an error signal or notifies that an error has occurred.

At automatic document feeder 20, the time starting from the point of time (T22) when Signal3 is switched from high level to low level until the above-described T23 is substantially constant. Therefore, the reference value for the time in the determination of the occurrence of an error in document transportation may be set in association with time starting from T22 to T23, instead of T21 to T23 set forth above at automatic document feeder 20. In this case, when Signal4 is not switched from low level to high level even at an elapse of the time of the reference value from the switching of Signal3 from high level to low level, CPU 101 outputs an error signal, or informs that an error is occurring.

[Automatic Document Feeder Operation Timing in Operation Confirmation Mode]

At automatic document feeder 20, operation confirmation is made, at the time of turning ON the power and/or at the time of returning from a jamming state, to confirm that sensor unit 29 is operating properly and/or the document on the transportation path (causing jamming) has been removed. This operation confirmation is made by temporal excitation of clutch solenoid L2 without rotation of send-out roller 22, followed by determination of an output from photosensor 292 when excitation of clutch solenoid L2 is stopped.

Figure 12:
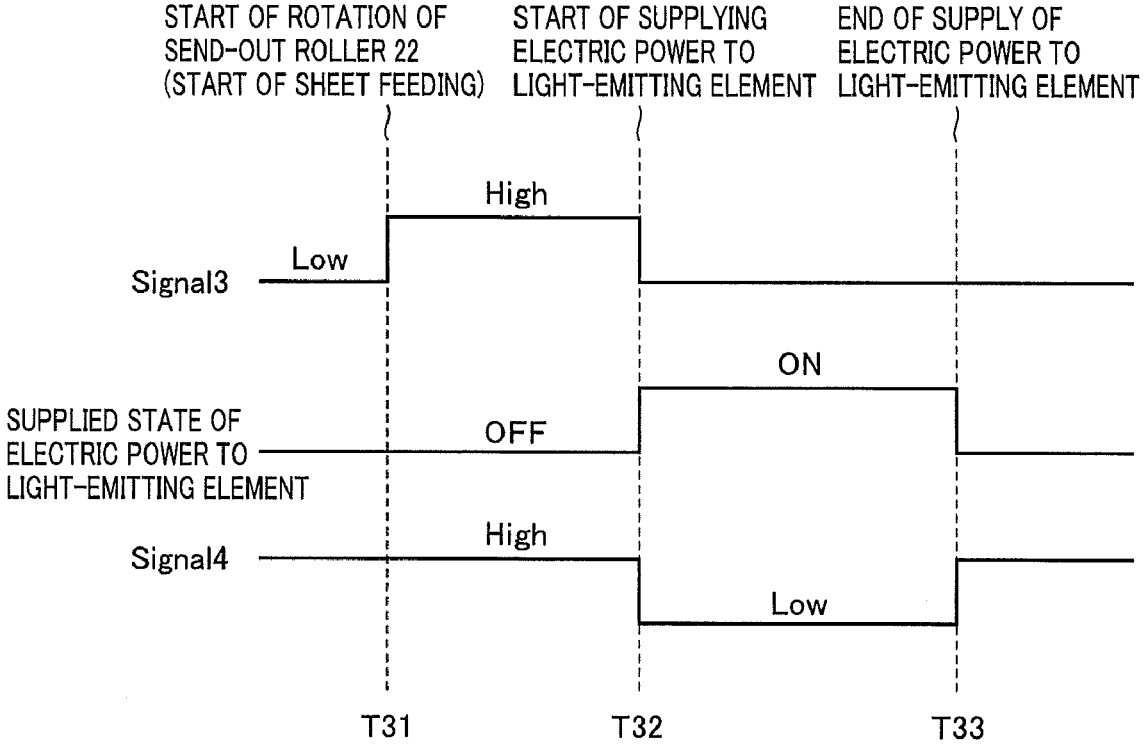
FIG. 12 is a timing chart representing the ON/OFF timing of an electromagnetic component at the automatic document feeder and the operation timing of the detector in an operation confirmation mode of the MFP.

FIG. 12 is a timing chart representing the ON/OFF timing of an electromagnetic component (clutch solenoid L2) and operation timing of the detector (photosensor 292) in an operation confirmation mode of MFP 1.

Likewise with FIG. 11, FIG. 12 shows, from the upper side, the state of Signal3, the supplied state of counter electromotive force to light-emitting element 292A, and the state of a detection signal from light-receiving element 292B towards CPU 101. In an operation confirmation mode, CPU 101 does not apply current to motor 220. Accordingly, Signal3 of high level is output, and send-out roller 22 is not rotated even if clutch solenoid L2 is turned ON in an operation confirmation mode.

Referring to FIG. 12 corresponding to an operation confirmation mode, CPU 101 outputs Signal3 of high level from time T31 to T32, and then switches Signal3 to low level. Accordingly, counter electromotive force is induced at clutch solenoid L2 at time T32. Therefore, the electric power supply state to light-emitting element 292A is switched from OFF to ON at time T32. In response, light-receiving element 292B begins to receive the light generated by light-emitting element 292A, whereby Signal4 is switched from high level to low level at time T32.

In the example of FIG. 12, the counter electromotive force of clutch solenoid L2 is supplied to light-emitting element 292A from time T32 to time T33. Accordingly, the electric power supply state to light-emitting element 292A is switched OFF at time T33. The output of Signal4 is switched from low level to high level.

FIG. 12 is a timing chart when proper operation is executed.

For example, in the case where light-emitting element 292A is damaged so that light is not generated, light-emitting element 292A cannot emit light even if CPU 101 outputs Signal3 of high level. Accordingly, the output of Signal4 is not switched to low level, and remains high. Thus, when the output of Signal4 is not switched to low level even if a predetermined time elapses from the switching of Signal3 to low level, CPU 101 notifies an error, Even if light-emitting element 292A generates light, Signal4 will remain low in the case where light-receiving element 292B cannot receive the light generated from light-emitting element 292A due to a document being stuck, for example, in the transportation path. Thus, CPU 101 notifies an error when the output Signal4 is not switched from high level to low level at an appropriate timing. Therefore, in the case where Signal4 remains low due to a sheet being stuck, for example, and is not switched from high level to low level at an appropriate timing, an error is notified by CPU 101.

[Summarization of Operation of Document Transportation Mechanism]

In the present embodiment set forth above, the transportation unit is constituted of send-out roller 22 transporting a document along the transportation path in response to application of current to clutch solenoid L2.

The detection unit is constituted of photosensor 292 arranged downstream of send-out roller 22 in the transportation path for detecting absence/presence of a document in the transportation path.

The supply unit supplying the counter electromotive force induced at an electromagnetic component as the electric power for a detector is constituted of rectify diode D3, capacitor C2, diode D4 and resistor R3 (refer to FIG. 10) provided to send the counter electromotive force induced at clutch solenoid L2 to light emitting 292A without reverse flow.

Further, the counter electromotive force induced at clutch solenoid L2 is rectified by rectify diode D3, and then delivered to light-emitting element 292A via resistor R3. Accordingly, when current is applied to clutch solenoid L2 for rotation of send-out roller 22 to transport a document, the counter electromotive force induced by stopping the application of current is supplied to light-emitting element 292A at a timing allowing detection of passage of the relevant document through the transportation path.

In the present embodiment, the electromagnetic component is not limited to clutch solenoid L2. In the case where MFP 1 is absent of clutch solenoid L2, and send-out roller 22 is directly coupled with motor 220, application of current to motor 220 is initiated when rotation of send-out roller 22 is started, and application of current to motor 220 is stopped when the rotation is ceased. MFP 1 may be configured such that the counter electromotive force induced at motor 220 is supplied to light-emitting element 292A in response to stopping the application of current to motor 220 by having motor 520 connected instead of clutch solenoid L2 in FIG. 10, for example.

5. Post-Processing Mechanism

MFP 1 of the present embodiment includes a post-processing device for carrying out post-processing such as punching and stapling by finisher 60 for a recording sheet paper (sheet) on which an image is formed by print engine 40.

At finisher 60, the counter electromotive force induced at an electromagnetic component utilized in the transportation of a recording paper (sheet) can be supplied to a component (detector) for detecting a document on the transportation path.

Figure 13:
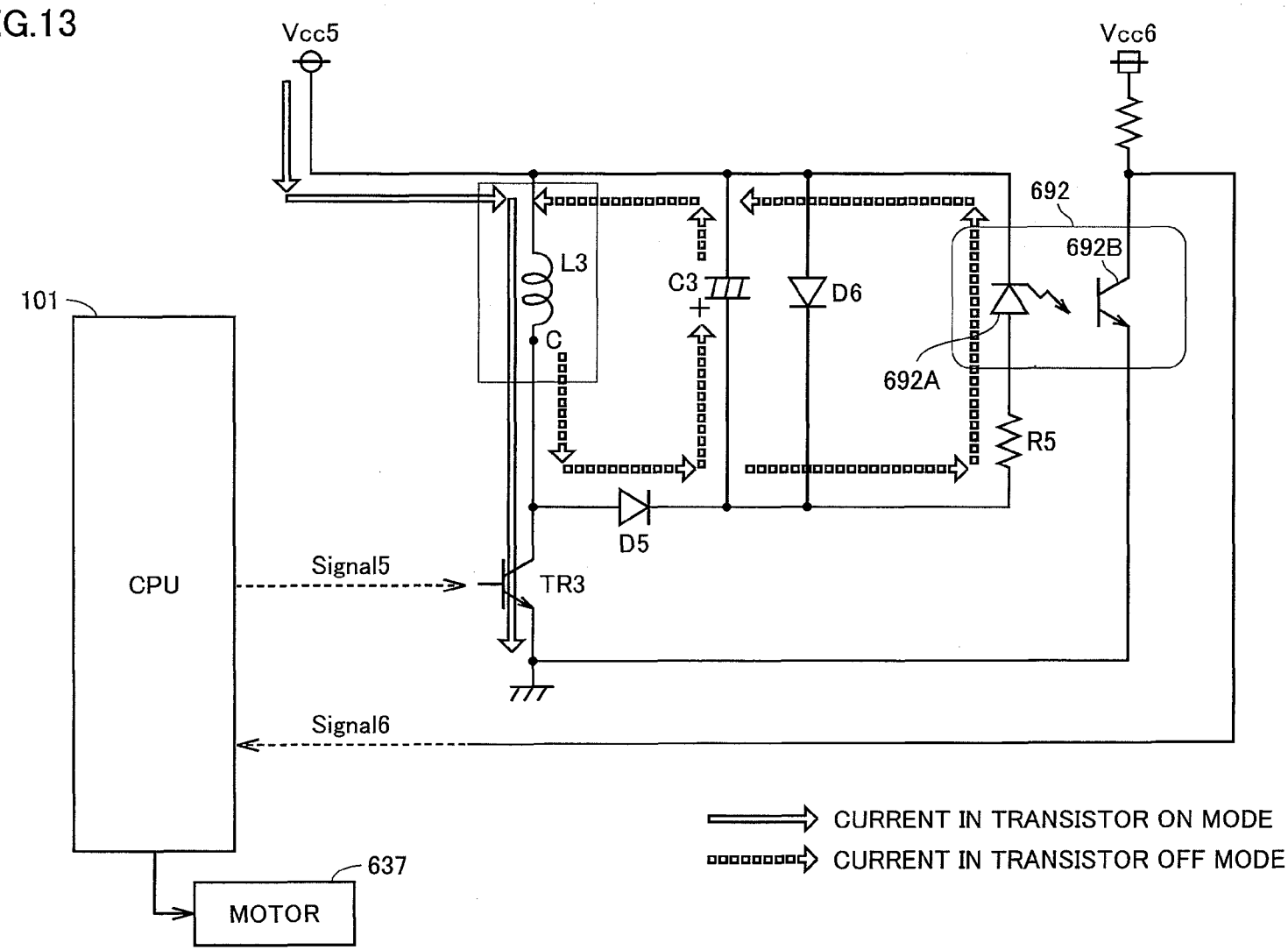
FIG. 13 is a circuit diagram directed to utilizing the counter electromotive force of an electromagnetic component at a finisher of the MFP as the driving source of the detector.

FIG. 13 is a circuit diagram directed to utilizing the counter electromotive force of an electromagnetic component (clutch solenoid L3) at finisher 60 as the electric power source of the detector (photosensor 692 in sensor unit 69).

Referring to FIG. 13, the transition of transistor TR3 to ON at finisher 60 causes current to be applied to clutch solenoid L3 from direct current power supply Vcc5, whereby clutch solenoid L3 is excited. Excitation of clutch solenoid L3 establishes a coupled state between aforementioned roller pair 637*a* (refer to FIG. 1) and a member such as a gear. Motor 637 functions to apply rotation force to roller pair 637*a*. When transistor TR3 is turned ON in an ON state of motor 637, the rotation force of motor 637 is transmitted to roller pair 637*a*. Accordingly, roller pair 637*a* is rotated to cause a document on document feed tray 21 to be sent to the transportation path. In FIG. 13, the flow of current in an excitation mode of clutch solenoid L3 is represented by an open arrow.

Sensor unit 69 includes, for example, photosensor 692. Photosensor 692 includes light-emitting element 692A and light-receiving element 692B.

At finisher 60, transistor TR3 is turned ON in response CPU 101 providing a remote signal Signal5 of high level to transistor TR3.

When CPU 101 outputs Signal5 of low level to transistor TR3, transistor TR3 is turned OFF. The transition of transistor TR3 from ON to OFF causes generation of counter electromotive force at clutch solenoid L3, whereby the voltage at point C becomes higher than the level of direct current power supply Vcc5.

In FIG. 13, the flow of current at the transition of transistor TR3 from ON to OFF is indicated by the broken line arrow.

Since the voltage at point C becomes higher than the level of direct current power supply Vcc5 due to the counter electromotive force induced at clutch solenoid L3 in response to the transition of transistor TR3 from ON to OFF, smoothing electrolytic capacitor C3 is charged via rectify diode D5. The electric power charged to smoothing electrolytic capacitor C3 is supplied to a resistor R5 connected parallel to smoothing electrolytic capacitor C3 and the element at the light emitting side element (light-emitting element 692A) of photosensor 692 that is a detector. This flow of current to light-emitting element 692A causes the relevant light-emitting element 692A to generate light, whereby photosensor 692 will start to operate. Diode D6 is provided to prevent reverse voltage from being applied to smoothing electrolytic capacitor C3 under an OFF state of transistor TR3.

Comparing finisher 60 of FIG. 13 with sheet feeder 50 described with reference to FIG. 6, transistor TR3 corresponds to transistor TRI, clutch solenoid L3 corresponds to clutch solenoid L1, light-emitting element 692A corresponds to light-emitting element 592A, and light-receiving element 692B corresponds to light-receiving element 592B.

[Operation Timing of Recording Sheet Transportation at Finisher]

Figure 14:
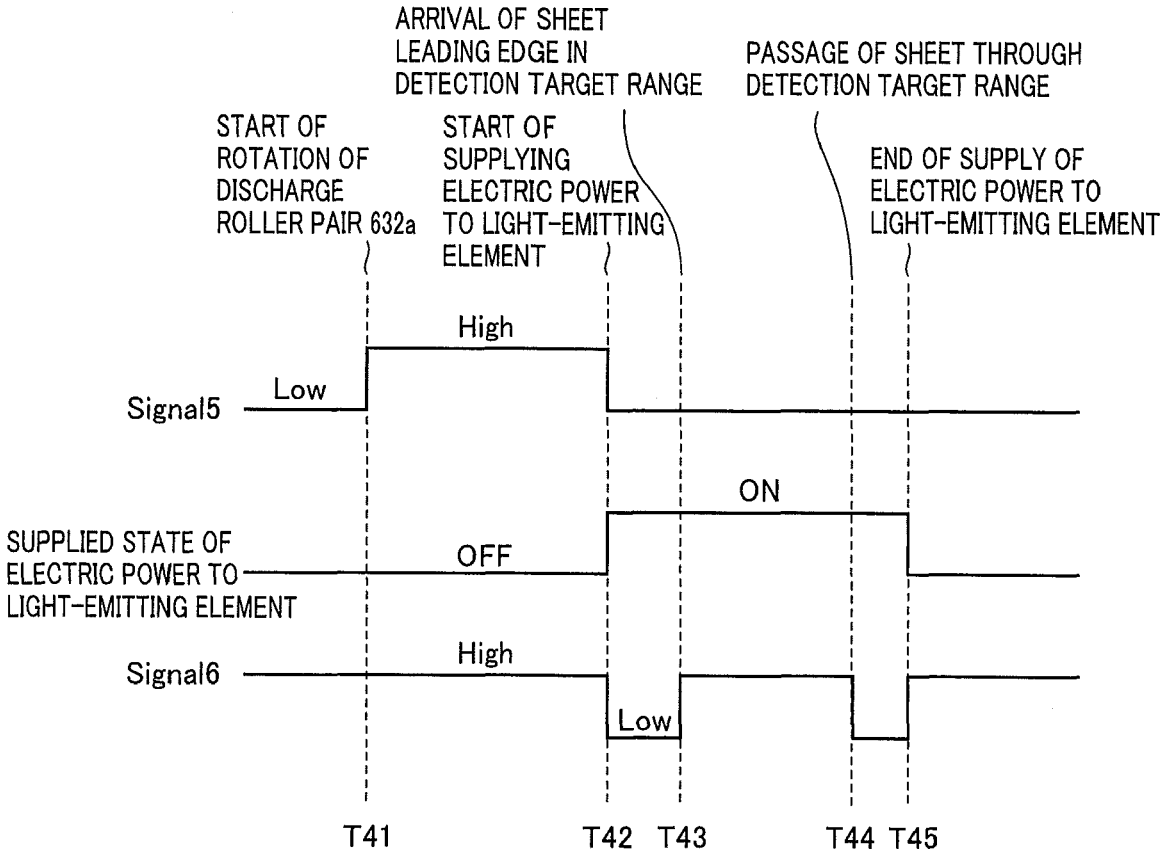
FIG. 14 is a timing chart representing the ON/OFF timing of an electromagnetic component at the automatic document feeder and the operation timing of a detector in a transportation mode of a sheet at the finisher of the MFP.

FIG. 14 is a timing chart representing the ON/OFF timing of an electromagnetic component (clutch solenoid L3) and the operating timing of a detector (photosensor 692) in a transportation mode of a recording sheet at finisher 60. FIG. 14 shows, from the upper side, the state of Signal5, the supplied state of counter electromotive force to light-emitting element 692A, and the state of a detection signal (Signal6) from light-receiving element 692B towards CPU 101. Light-receiving element 692B receives electric power from direct current power supply Vcc6, and outputs a low level signal and a high level signal as Signal6 to CPU 101 when receiving and not receiving, respectively, the light generated from light-emitting element 692A.

Referring to FIG. 14, CPU 101 outputs a high level Signal5 to transistor TR3 from time T41 to time T42. It is to be noted that CPU 101 has motor 637 turned ON prior to time T41. Therefore, the rotation force of motor 637 is transmitted to roller pair 637*a* during an high level output period of Signal5, whereby the recording sheet delivered to finisher 60 is output onto the transportation path in finisher 60 that includes punch unit 626 (refer to FIG. 1).

When Signal5 is switched from high level to low level at time T42, the counter electromotive force induced at clutch solenoid L3 is supplied to light-emitting element 692A. Accordingly, the electric power supply state towards light-emitting element 692A, corresponding to the second stage in FIG. 14, is switched from an OFF state to an ON state at time T42. By the start of supplying electric power to light-emitting element 692A, light-receiving element 692B receives the light generated by light-emitting element 692A, whereby Signal6 is switched from high level to low level at time T42.

Meanwhile, the recording sheet transferred to the transportation path by the rotation of roller pair 637*a* attains a state preventing light-receiving element 692B from receiving the light generated by light-emitting element 692A.

FIG. 14 represents an example where the leading edge of the recording sheet arrives at the detecting position by sensor unit 69 to prevent light reception at time T43. The arrival of the leading edge of the recording sheet at the detecting position by sensor unit 69 at time T43 prevents light-receiving element 692B from receiving the light generated by light-emitting element 692A. Accordingly, Signal6 is switched from low level to high level at time T43.

FIG. 14 corresponds to an example where the recording sheet arriving at the detecting position by sensor unit 69 at time T43 passes the detecting position by sensor unit 69 at time T44. By the passage of the recording sheet through the detecting position by sensor unit 69 at time T44, light-receiving element 692B attains a state allowing reception of the light generated by light-emitting element 692A. Thus, Signal6 is switched from high level to low level at time T44.

FIG. 14 represents the example where the counter electromotive force of clutch solenoid L3 is supplied to light-emitting element 692A until time T45. Namely, referring to the second stage in FIG. 14, the drive source supply state to light-emitting element 692A is switched to OFF at time T45, When supply of the counter electromotive force to light-emitting element 692A ends at time T45, light-receiving element 692B will not be able to receive light generated from light-emitting element 692A. Accordingly, the output Signal6 is switched from low level to high level at time T45.

At finisher 60, the recording sheet transportation speed is determined in advance, and the distance from roller pair 637*a* to the detecting position by sensor unit 69 is constant. Therefore, the time starting from the switching of Signal5 from low level to high level (T41) up to a point of time when the leading edge of the transported recording sheet arrives at the detecting position by sensor unit 69 (T43) is substantially constant.

CPU 101 obtains in advance the reference value for a period of time, starting from the switching of Signal5 from low level to high level until arrival of the leading edge of the recording sheet at a detecting position by sensor unit 69, based on the transportation speed and the like of the recording sheet.

When Signal6 is not switched from low level to high level even at an elapse of the time of the reference value from the switching of Signal5 from low level to high level, CPU 101 determines that an error has occurred in the transportation of the recording sheet (jamming or the like), and outputs an error signal or notifies that an error has occurred.

At finisher 60, the time starting from the point of time (T42) when Signal5 is switched from high level to low level until the above-described T43 is substantially constant. Therefore, the reference value for the time used in the determination of the occurrence of an error in recording sheet transportation may be set in association with time starting from T42 to T43, instead of T41 to T43 set forth above. In this case, when Signal6 is not switched from low level to high level even at an elapse of the time of the reference value from the switching of Signal5 from high level to low level, CPU 101 outputs an error signal, or informs that an error is occurring.

[Finisher Operation Timing in Operation Confirmation Mode]

At finisher 60, operation confirmation is made, at the time of turning ON the power and/or at the time of returning from a jamming state, to confirm that sensor unit 69 is operating properly and/or the recording sheet on the transportation path (causing jamming) has been removed. This operation confirmation is made by temporal excitation of clutch solenoid L3 without rotation of roller pair 637*a*, followed by determination of an output from photosensor 692 when excitation of clutch solenoid L3 is stopped.

Figure 15:
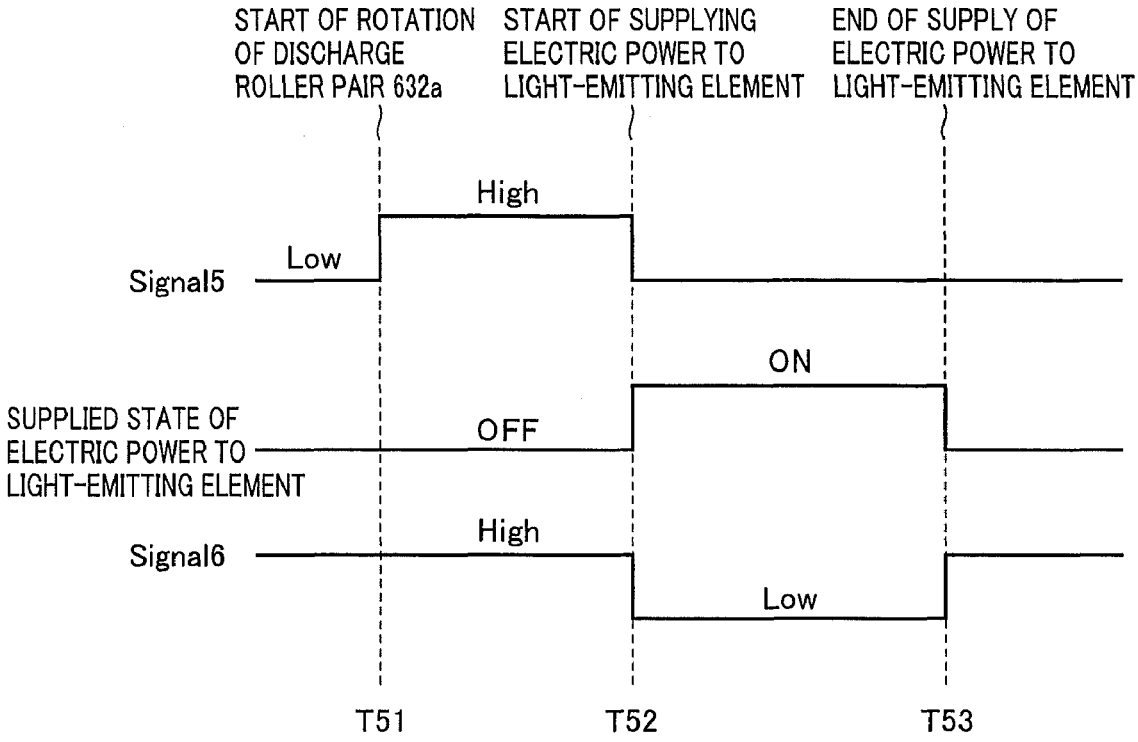
FIG. 15 is a timing chart representing the ON/OFF timing of an electromagnetic component at the finisher and the operation timing of the detector in an operation confirmation mode of the MFP.

FIG. 15 is a timing chart representing the ON/OFF timing of an electromagnetic component (clutch solenoid L3) and operation timing of the detector (photosensor 692) in an operation confirmation mode of MFP 1.

Likewise with FIG. 14, FIG. 15 shows, from the upper side, the state of Signal5, the supplied state of counter electromotive force to light-emitting element 692A, and the state of a detection signal from light-receiving element 692B towards CPU 101. In an operation confirmation mode, CPU 101 does not apply current to motor 637. Accordingly, Signal5 of high level is output, and roller pair 637*a* is not rotated even if clutch solenoid L3 is turned ON in an operation confirmation mode.

Referring to FIG. 15 corresponding to an operation confirmation mode, CPU 101 outputs Signal5 of high level from time T51 to T52, and then switches Signal5 to low level. Accordingly, counter electromotive force is induced at clutch solenoid L3 at time T52. Therefore, the electric power supply state to light-emitting element 692A is switched from OFF to ON at time T52. In response, light-receiving element 692B begins to receive the light generated by light-emitting element 692A, whereby Signal6 is switched from high level to low level at time T52.

In the example of FIG. 15, the counter electromotive force of clutch solenoid L3 is supplied to light-emitting element 692A from time T52 to time T53. Accordingly, the electric power supply state to light-emitting element 692A is switched OFF at time T53. The output of Signal6 is switched from low level to high level.

FIG. 15 is a timing chart when proper operation is executed.

For example, in the case where light-emitting element 692A is damaged so that light is not generated, light-emitting element 692A cannot emit light even if CPU 101 outputs Signal5 of high level. Accordingly, the output of Signal6 is not switched to low level, and remains high. Thus, when the output of Signal6 is not switched to low level even if a predetermined time elapses from the switching of Signal5 to low level, CPU 101 notifies an error.

Even if light-emitting element 692A generates light, Signal6 will remain low in the case where light-receiving element 692B cannot receive the light generated from light-emitting element 692A due to a recording sheet being stuck, for example, in the transportation path. Thus, CPU 101 notifies an error when the output Signal6 is not switched from high level to low level at an appropriate timing. Therefore, in the case where Signal6 remains low due to a sheet being stuck, for example, and is not switched from high level to low level at an appropriate timing, an error is notified by CPU 101.

[Summarization of Recording Sheet Transportation Mechanism Operation at Finisher]

In the present embodiment set forth above, the transportation unit is constituted of roller pair 637*a* transporting a recording sheet along the transportation path in response to application of current to clutch solenoid L3.

The detection unit is constituted of photosensor 692 arranged downstream of roller pair 637*a* in the recording sheet transportation path for detecting absence/presence of a document in the transportation path.

The supply unit supplying the counter electromotive force induced at an electromagnetic component as the electric power for a detector is constituted of rectify diode D5, capacitor C3, diode D6 and resistor R5 (refer to FIG. 13) provided to send the counter electromotive force induced at clutch solenoid L3 to light emitting 692A without reverse flow.

Further, the counter electromotive force induced at clutch solenoid L3 is rectified by rectify diode D5, and then delivered to light-emitting element 692A via resistor R5. Accordingly, when current is applied to clutch solenoid L3 for rotation of roller pair 637*a* to transport a recording sheet, the counter electromotive force induced by stopping the application of current is supplied to light-emitting element 692A at a timing allowing detection of passage of the relevant recording sheet through the transportation path.

In the present embodiment, the electromagnetic component is not limited to clutch solenoid L3. In the case where MFP 1 is absent of clutch solenoid L3, and roller pair 637*a* is directly coupled with motor 637, application of current to motor 637 is initiated when rotation of roller pair 637*a* is started, and application of current to motor 637 is stopped when the rotation is ceased. MFP 1 may be configured such that the counter electromotive force induced at motor 637 is supplied to light-emitting element 692A in response to stopping the application of current to motor 637 by having motor 637 connected instead of clutch solenoid L3 in FIG. 13, for example.

6. Summarization Of Embodiment

In the present embodiment, MFP 1 having a mechanism of transporting recording sheet P along transportation path 500 through rotation of sheet feed roller 52, described with reference to FIG. 6, constitutes a sheet transportation device.

As described mainly with reference to FIGS. 13-15 for the transportation of a recording sheet at finisher 60 in MFP 1, finisher 60 (post-processing device) having a mechanism of transporting a recording sheet through the rotation of roller pair 637*a* constitutes the sheet transportation device. It is considered that finisher 60 can be separated from the other sections of MFP 1 (automatic document feeder 20, scanner 30, print engine 40, and sheet feeder 50), and may be handled independently.

In the present embodiment, an image reader device formed of automatic document feeder 20 and scanner 30 having the mechanism of transporting a document along the transportation path through rotation of send-out motor 22 constitutes the sheet transportation device. Automatic document feeder 20 that is an example of a sheet transportation device of the present invention may be configured as a portion of MFP 1, as set forth in the present embodiment, may be configured independently and handled as an device automatically transporting a sheet such as a document, or configured independently and handled as a scanner device in combination with a device that functions equivalent to scanner 30.

The present embodiment allows the reliability of a sheet transportation device to be ensured by avoiding damage of a component caused by counter electromotive force expected to be induced through application of current to an electromagnetic component while reducing power consumption as the entire device.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A sheet transportation device comprising:

a transportation path for transportation of a sheet;

a transportation unit for applying force to a sheet on said transportation path;

an electromagnetic component for driving said transportation unit by supply of electric power;

a detector, for detecting absence/presence of a sheet at said transportation path, the detector being provided at said transportation path downstream of a region where said transportation unit applies force to a sheet;

a supply unit supplying, as electric power to said detector, counter electromotive force induced in response to said electromagnetic component receiving supply of electric power for driving said transportation unit; and a control unit for controlling application of current to said electromagnetic component, wherein said supply unit further includes a switching element for switching ON/OFF of application of current to said electromagnetic component, said control unit controls application of current to said electromagnetic component by switching ON/OFF of said switching element.

2. The sheet transportation device according to claim 1, wherein said supply unit supplies to said detector, as electric power, the counter electromotive force induced during transportation of a sheet.

3. The sheet transportation device according to claim 2, further comprising a power supply supplying electric power to said electromagnetic component, wherein said transportation unit transports a sheet at a speed such that a trailing edge of said sheet passes a detecting position by said detector after a predetermined time from said transportation unit applying force to said sheet, a value of current supplied to said electromagnetic component from said power supply, and an electrical property of said electromagnetic component are set by the power supply such that said counter electromotive force is used as electric power supplied to said detector for at least said predetermined time.

4. The sheet transportation device according to claim 1, wherein said supply unit comprises a capacitor for storing charge by current flowing through said counter electromotive force, and a diode for rectifying current flowing through said counter electromotive force.

5. The sheet transportation device according to claim 1, wherein said switching element includes a bipolar transistor.

6. The sheet transportation device according to claim 1, wherein said electromagnetic component includes a solenoid, said transportation unit comprises a motor, and a roller abutting against a sheet, and rotating by a driving force of said motor, said solenoid switching between transmitting and not transmitting the driving force of said motor to said roller, said sheet transportation device further comprising a control unit controlling whether to rotate said motor or not, said control unit performing an operation confirmation of said sheet transportation device based on a detection output from said detector when current is applied to said solenoid in a state where said motor is not rotated.

7. The sheet transportation device according to claim 1, wherein said detector includes a photosensor.

8. The sheet transportation device according to claim 1, wherein a sheet transported by said transportation unit includes a recording sheet having an image formed, and said sheet transportation device is constituted of an image formation apparatus.

9. The sheet transportation device according to claim 1, wherein a sheet transported by said transportation unit includes a recording sheet having an image formed, and said sheet transportation device is constituted of a post-processing device applying post-processing to a sheet having an image formed.

10. The sheet transportation device according to claim 1, wherein a sheet transported by said transportation unit is a document from which an image is scanned, and said sheet transportation device includes an image reader device.

11. A sheet transportation device comprising:

a transportation path for transportation of a sheet;

a transportation unit for applying force to a sheet on said transportation path including a motor and a roller abutting against a sheet, and rotating by driving force of said motor;

an electromagnetic component for driving said transportation unit by supply of electric power, and including a solenoid that switches between transmitting and not transmitting the driving force of said motor to said roller;

a detector, for detecting absence/presence of a sheet at said transportation path, the detector being provided at said transportation path downstream of a region where said transportation unit applies force to a sheet;

a supply unit supplying, as electric power to said detector, counter electromotive force induced in response to said electromagnetic component receiving supply of electric power for driving said transportation unit; and a control unit controlling whether to rotate said motor or not, wherein said control unit performs an operation confirmation of said sheet transportation device based on a detection output from said detector when current is applied to said solenoid in a state where said motor is not rotated, and said control unit determines, in said operation confirmation, that said detector is operating properly when the detection output from said detector indicates that there is no sheet in said transportation path.

12. The sheet transportation device according to claim 11, wherein said control unit determines that jamming of a sheet is not occurring in said transportation path when the detection output from said detector indicates that there is no sheet at said transportation path, in said operation confirmation.

13. The sheet transportation device according to claim 11, wherein said supply unit supplies to said detector, as electric power, the counter electromotive force induced during transportation of a sheet.

14. The sheet transportation device according to claim 11, further comprising a power supply supplying electric power to said electromagnetic component, wherein said transportation unit transports a sheet at a speed such that a trailing edge of said sheet passes a detecting position by said detector after a predetermined time from said transportation unit applying force to said sheet, a value of current supplied to said electromagnetic component from said power supply, and an electrical property of said electromagnetic component are set by the power supply such that said counter electromotive force is used as electric power supplied to said detector for at least said predetermined time.

15. The sheet transportation device according to claim 11, wherein said supply unit comprises a capacitor for storing charge by current flowing through said counter electromotive force, and a diode for rectifying current flowing through said counter electromotive force.

16. The sheet transportation device according to claim 11, wherein said detector includes a photosensor.

17. The sheet transportation device according to claim 11, wherein a sheet transported by said transportation unit includes a recording sheet having an image formed, and said sheet transportation device is constituted of an image formation apparatus.

18. The sheet transportation device according to claim 11, wherein a sheet transported by said transportation unit includes a recording sheet having an image formed, and said sheet transportation device is constituted of a post-processing device applying post-processing to a sheet having an image formed.

19. The sheet transportation device according to claim 11, wherein a sheet transported by said transportation unit is a document from which an image is scanned, and said sheet transportation device includes an image reader device.

20. A control method of a sheet transportation device including a transportation unit for applying force to a sheet on a transportation path, an electromagnetic component for driving said transportation unit by receiving supply of electric power, and a detector for detecting absence/presence of a sheet on said transportation unit, said control method comprising the steps of:

supplying electric power to said electromagnetic component for said transportation unit to apply force to a sheet, detecting absence/presence of a sheet in said transportation path at a downstream side of a region where said transportation unit applies force to a sheet in said transportation path, and supplying, to said detector, counter electromotive force induced during transportation of a sheet as electric power to detect said sheet in response to said electromagnetic component receiving supply of electric power, said sheet transportation device further including a power supply supplying electric power to said electromagnetic component, wherein said transportation unit applies force to a sheet on said transportation path at a speed such that a trailing edge of said sheet passes a detecting position by said detector after a predetermined time from applying force to the sheet on said transportation path, and a value of current supplied to said electromagnetic component from said power supply, and an electrical property of said electromagnetic component are set such that said counter electromotive force is used as electric power supplied to said detector for at least said predetermined time.

21. The control method of a sheet transportation device according to claim 20, said sheet transportation device further including a capacitor and a diode, wherein said step of supplying counter electromotive force to said detector stores charge by current flowing through said counter electromotive force at said capacitor, and rectifies current flowing through said counter electromotive force by said diode.

22. The control method of a sheet transportation device according to claim 20, said electromagnetic component including a solenoid, wherein said transportation unit comprises a motor, and a roller abutting against a sheet, and rotating by a driving force of said motor, said solenoid switching between transmitting and not transmitting the driving force of said motor to said roller, said sheet transportation device further including a control unit controlling whether to rotate said motor or not, said control method further comprising the step of performing an operation confirmation of said sheet transportation device based on a detection output from said detector when current is applied to said solenoid in a state where said motor is not rotated.

23. A control method of a sheet transportation device including a transportation unit for applying force to a sheet on a transportation path, an electromagnetic component for driving said transportation unit by receiving supply of electric power, and a detector for detecting absence/presence of a sheet on said transportation unit, said control method comprising the steps of:

supplying electric power to said electromagnetic component for said transportation unit to apply force to a sheet, detecting absence/presence of a sheet in said transportation path at a downstream side of a region where said transportation unit applies force to a sheet in said transportation path, and supplying, to said detector, counter electromotive force induced in response to said electromagnetic component receiving supply of electric power, said sheet transportation device further including a switching element, wherein said step of supplying electric power to said electromagnetic component controls application of current to said electromagnetic component by switching ON/OFF of said switching element.

24. The control method of a sheet transportation device according to claim 23, said sheet transportation device further including a capacitor and a diode, wherein said step of supplying counter electromotive force to said detector stores charge by current flowing through said counter electromotive force at said capacitor, and rectifies current flowing through said counter electromotive force by said diode.

25. A control method of a sheet transportation device including a transportation unit for applying force to a sheet on a transportation path, an electromagnetic component for driving said transportation unit by receiving supply of electric power, and a detector for detecting absence/presence of a sheet on said transportation unit, said control method comprising the steps of:

supplying electric power to said electromagnetic component for said transportation unit to apply force to a sheet, detecting absence/presence of a sheet in said transportation path at a downstream side of a region where said transportation unit applies force to a sheet in said transportation path, and supplying, to said detector, counter electromotive force induced in response to said electromagnetic component receiving supply of electric power, wherein said transportation unit comprises a motor and a roller abutting against a sheet, and rotating by a driving force of said motor, said solenoid switching between transmitting and not transmitting the driving force of said motor to said roller, said sheet transportation device further including a control unit controlling whether to rotate said motor or not, said control method further comprising the step of performing an operation confirmation of said sheet transportation device based on a detection output from said detector when current is applied to said solenoid in a state where said motor is not rotated, and wherein said step of performing operation confirmation determines that said detector operates properly when the detection output from said detector indicates that there is no sheet in said transportation path.

26. The control method of a sheet transportation device according to claim 25, wherein said step of performing operation confirmation determines that jamming of a sheet is not occurring in said transportation path when the detection output from said detector indicates that there is no sheet in said transportation path.

27. The control method of a sheet transportation device according to claim 25, said sheet transportation device further including a capacitor and a diode, wherein said step of supplying counter electromotive force to said detector stores charge by current flowing through said counter electromotive force at said capacitor, and rectifies current flowing through said counter electromotive force by said diode.

* * * * *